US011789383B2

(12) United States Patent
Yamaguchi et al.

(10) Patent No.: US 11,789,383 B2
(45) Date of Patent: Oct. 17, 2023

(54) IMAGE FORMING APPARATUS

(71) Applicants: Jumpei Yamaguchi, Kanagawa (JP); Koji Kiryu, Tokyo (JP); Masahiro Ashikawa, Kanagawa (JP); Masashi Kasamai, Kanagawa (JP); Kanji Ubukata, Kanagawa (JP); Nagisa Nakamura, Shizuoka (JP)

(72) Inventors: Jumpei Yamaguchi, Kanagawa (JP); Koji Kiryu, Tokyo (JP); Masahiro Ashikawa, Kanagawa (JP); Masashi Kasamai, Kanagawa (JP); Kanji Ubukata, Kanagawa (JP); Nagisa Nakamura, Shizuoka (JP)

(73) Assignee: RICOH COMPANY, LTD., Tokyo (JP)

( * ) Notice: Subject to any disclaimer, the term of this patent is extended or adjusted under 35 U.S.C. 154(b) by 0 days.

(21) Appl. No.: 17/731,280

(22) Filed: Apr. 28, 2022

(65) Prior Publication Data

US 2022/0357687 A1 Nov. 10, 2022

(30) Foreign Application Priority Data

May 10, 2021 (JP) ..... 2021-079632

(51) Int. Cl.

| | |
|---|---|
| ***G03G 15/16*** | (2006.01) |
| ***G03G 15/00*** | (2006.01) |
| ***G03G 15/01*** | (2006.01) |

(52) U.S. Cl.

CPC ..... *G03G 15/1615* (2013.01); *G03G 15/0189* (2013.01); *G03G 15/5008* (2013.01); *G03G 15/5058* (2013.01); *G03G 15/55* (2013.01)

(58) Field of Classification Search

CPC ..... G03G 15/0189; G03G 15/5008; G03G 15/5058; G03G 15/55; G03G 15/1615

See application file for complete search history.

(56) References Cited

U.S. PATENT DOCUMENTS 6,049,690 A * 4/2000 Nakayasu ..... H02P 5/56 399/306
6,278,857 B1 * 8/2001 Monji ..... G03G 15/0194 347/116

(Continued)

FOREIGN PATENT DOCUMENTS

| | | |
|---|---|---|
| JP | 2006-259176 | 9/2006 |
| JP | 2008-275800 | 11/2008 |
| JP | 2017-083311 | 5/2017 |

*Primary Examiner* — Carla J Therrien
(74) *Attorney, Agent, or Firm* — XSENSUS LLP

(57) ABSTRACT

An image forming apparatus includes a plurality of image bearers, a plurality of rotation reference position detectors, and circuitry. Each of the plurality of rotation reference position detectors faces a corresponding image bearer of the plurality of image bearers to detect a rotation reference position of the corresponding image bearer. The circuitry performs, before an operation of rotating the plurality of image bearers, alignment control based on a result of detection performed by the plurality of rotation reference position detectors. The alignment control is control of driving of the plurality of image bearers to acquire a given relationship between the respective rotation reference positions of the plurality of image bearers. The circuitry determines whether to perform the alignment control based on whether the operation of rotating the plurality of image bearers is a function maintenance related operation.

17 Claims, 11 Drawing Sheets

(56) References Cited

U.S. PATENT DOCUMENTS

| | | | | |
|---|---|---|---|---|
| 2006/0210313 | A1 | 9/2006 | Kosako | |
| 2008/0267673 | A1 | 10/2008 | Tao et al. | |
| 2009/0252534 | A1* | 10/2009 | Fukaya | G03G 15/5008 399/167 |
| 2010/0239293 | A1 | 9/2010 | Ishizaki et al. | |
| 2012/0237240 | A1 | 9/2012 | Kiryu | |
| 2013/0161900 | A1 | 6/2013 | Takahashi et al. | |
| 2014/0079444 | A1* | 3/2014 | Akamatsu | G03G 15/0178 399/301 |
| 2014/0169814 | A1* | 6/2014 | Uematsu | G03G 15/5058 399/49 |
| 2014/0255063 | A1 | 9/2014 | Kiryu | |
| 2014/0312563 | A1 | 10/2014 | Kasamai et al. | |
| 2017/0102659 | A1* | 4/2017 | Takaya | G03G 15/556 |
| 2017/0126905 | A1 | 5/2017 | Ishizaki et al. | |
| 2021/0278785 | A1 | 9/2021 | Ashikawa | |

* cited by examiner

IMAGE FORMING APPARATUS

CROSS-REFERENCE TO RELATED APPLICATIONS

This patent application is based on and claims priority pursuant to 35 U.S.C. § 119(a) to Japanese Patent Application No. 2021-079632, filed on May 10, 2021, in the Japan Patent Office, the entire disclosure of which is hereby incorporated by reference herein.

BACKGROUND

Technical Field

Embodiments of the present disclosure relate to an image forming apparatus for forming an image on a recording medium.

Related Art

An image forming apparatus in the related art includes a plurality of image bearers and a plurality of rotation reference position detectors to detect respective rotation reference positions of the plurality of image bearers. Before rotating the plurality of image bearers, the image forming apparatus performs alignment control for controlling driving of the plurality of image bearers based on a result of detection performed by the plurality of rotation reference position detectors, to acquire a given relationship between the respective rotation reference positions of the plurality of image bearers.

SUMMARY

In one embodiment of the present disclosure, a novel image forming apparatus includes a plurality of image bearers, a plurality of rotation reference position detectors, and circuitry. Each of the plurality of rotation reference position detectors faces a corresponding image bearer of the plurality of image bearers to detect a rotation reference position of the corresponding image bearer. The circuitry performs, before an operation of rotating the plurality of image bearers, alignment control based on a result of detection performed by the plurality of rotation reference position detectors. The alignment control is control of driving of the plurality of image bearers to acquire a given relationship between the respective rotation reference positions of the plurality of image bearers. The circuitry determines whether to perform the alignment control based on whether the operation of rotating the plurality of image bearers is a function maintenance related operation.

BRIEF DESCRIPTION OF THE DRAWINGS

A more complete appreciation of the disclosure and many of the attendant advantages and features thereof can be readily obtained and understood from the following detailed description with reference to the accompanying drawings, wherein.

Figure 1:
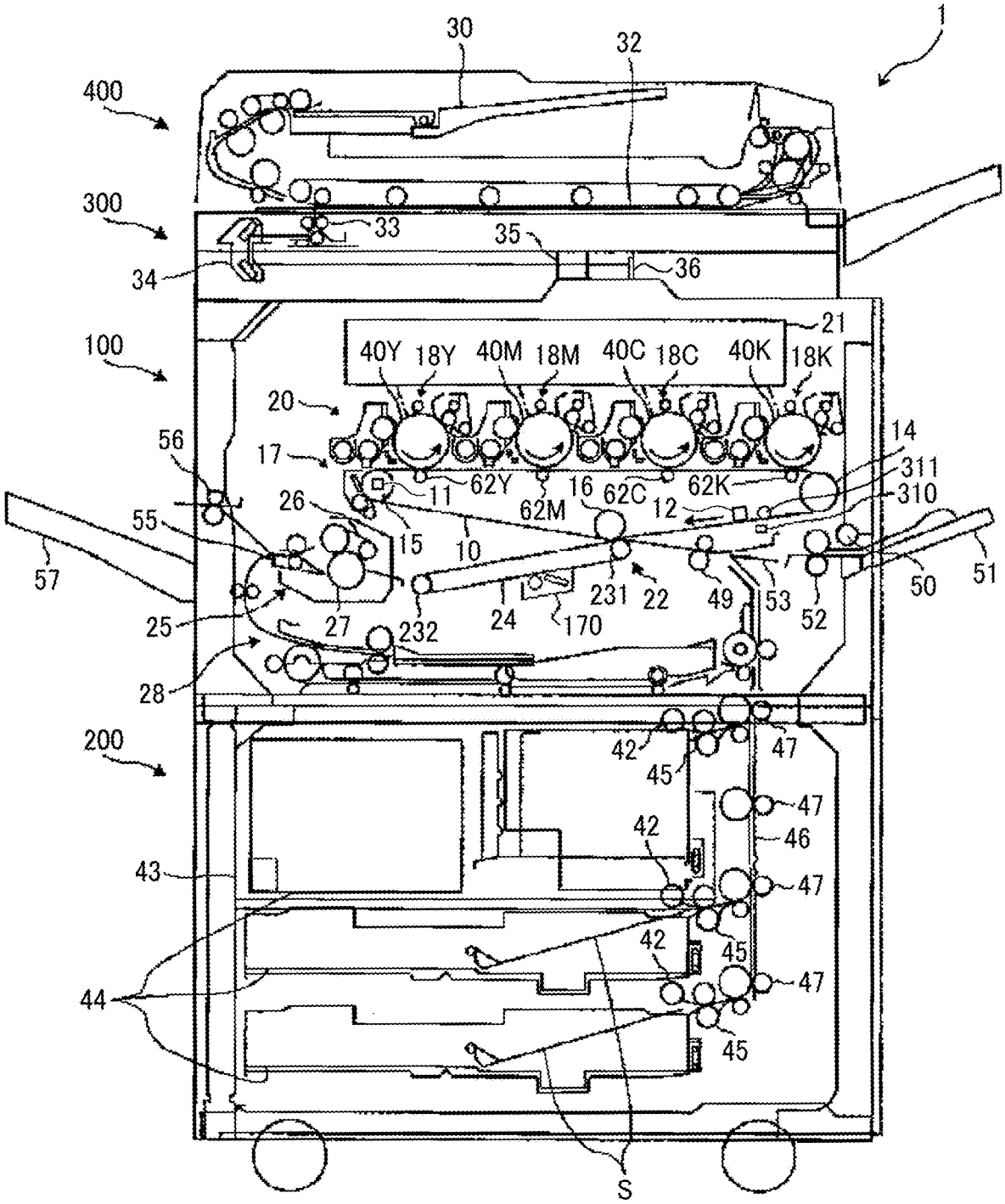
FIG. 1 is a schematic view of an image forming apparatus according to an embodiment of the present disclosure.

The accompanying drawings are intended to depict embodiments of the present invention and should not be interpreted to limit the scope thereof. The accompanying drawings are not to be considered as drawn to scale unless explicitly noted. Also, identical or similar reference numerals designate identical or similar components throughout the several views.

DETAILED DESCRIPTION

In describing embodiments illustrated in the drawings, specific terminology is employed for the sake of clarity. However, the disclosure of this specification is not intended to be limited to the specific terminology so selected and it is to be understood that each specific element includes all technical equivalents that have a similar function, operate in a similar manner, and achieve a similar result.

Referring now to the drawings, embodiments of the present disclosure are described below. As used herein, the singular forms "a," "an," and "the" are intended to include the plural forms as well, unless the context clearly indicates otherwise.

For the sake of simplicity, like reference numerals are given to identical or corresponding constituent elements such as parts and materials having the same functions, and redundant descriptions thereof are omitted unless otherwise required.

Note that, in the following description, suffixes Y, M, C, and K denote colors of yellow, magenta, cyan, and black, respectively. To simplify the description, these suffixes are omitted unless necessary.

As used herein, the term "connected/coupled" includes both direct connections and connections in which there are one or more intermediate connecting elements.

FIG. 1 is a schematic view of an image forming apparatus according to an embodiment of the present disclosure.

Referring to FIG. 1, an image forming apparatus 1 according to the present embodiment includes an apparatus body 100 serving as a printer unit, a sheet feeding device 200 serving as a recording medium supply unit on which the apparatus body 100 is placed, and a scanner 300 serving as an image reading device mounted on the apparatus body 100. The image forming apparatus 1 of the present embodiment further includes an automatic document feeder (ADF) 400 mounted on the scanner 300.

The apparatus body 100 includes, in the center of the apparatus body 100, an intermediate transfer belt 10 that is an endless belt serving as a surface mover and a first transfer device according to the present embodiment. The intermediate transfer belt 10 is entrained around a first support roller 14, a second support roller 15, and a third support roller 16 serving as three support rotators. The intermediate transfer belt 10 rotates clockwise in FIG. 1. An intermediate transfer belt cleaner 17 is disposed to the left of the second support roller 15 of the three support rollers in FIG. 1, to remove residual toner that remains on the intermediate transfer belt 10 after an image is transferred from the intermediate transfer belt 10. In addition, a tandem image forming device 20 is disposed facing a horizontal portion of the intermediate transfer belt 10 stretched taut between the first support roller 14 and second support roller 15 of the three support rollers. Note that the tandem image forming device 20 serves as an image forming device according to the present embodiment.

As illustrated in FIG. 1, the tandem image forming device 20 includes four image forming units 18Y, 18M, 18C, and 18K aligned along a belt moving direction in which the horizontal portion of the intermediate transfer belt 10 moves. The image forming units 18Y, 18M, 18C, and 18K form toner images of yellow, magenta, cyan, and black, respectively. The image forming apparatus 1 of the present embodiment uses the third support roller 16 as a drive roller. Above the tandem image forming device 20 is an exposure device 21.

A secondary transfer device 22 is disposed facing the tandem image forming device 20 across the intermediate transfer belt 10. Note that the secondary transfer device 22 serves as a second transfer device according to the present embodiment. The secondary transfer device 22 includes two rollers 231 and 232 and a secondary transfer belt 24 entrained around the two rollers 231 and 232. The secondary transfer belt 24 is an endless belt serving as a transfer sheet conveyor. The secondary transfer belt 24 is disposed to press against the third support roller 16 via the intermediate transfer belt 10. The secondary transfer device 22 transfers a toner image from the intermediate transfer belt 10 onto a transfer sheet S serving as a recording medium according to the present embodiment. Optionally, a cleaner 170 may be disposed to clean an outer circumferential surface of the secondary transfer belt 24 as illustrated in FIG. 1.

A fixing device 25 is disposed to the left of the secondary transfer device 22 in FIG. 1. The fixing device 25 fixes, onto the transfer sheet S, the toner image that has been transferred onto the transfer sheet S. The fixing device 25 includes a fixing belt 26 as an endless belt that is heated and a pressure roller 27 pressed against the fixing belt 26.

The secondary transfer device 22 has a sheet conveyance function to convey the transfer sheet S to the fixing device 25 after the toner image is transferred from the intermediate transfer belt 10 onto the transfer sheet S. Below the secondary transfer device 22 and the fixing device 25, a sheet reverse device 28 is disposed in parallel to the tandem image forming device 20 to reverse the transfer sheet S so that images are recorded on both sides of the transfer sheet S.

When, e.g., a user makes a copy with the image forming apparatus 1 having the configuration described above, the user places a document on a document tray 30 of the automatic document feeder 400. Alternatively, the user may open the automatic document feeder 400, place the document on a platen 32 as an exposure glass of the scanner 300, and close the automatic document feeder 400 to press the document against the platen 32. When the user places the document on the automatic document feeder 400 and presses a start switch on a control panel, the automatic document feeder 400 conveys the document to the platen 32.

By contrast, when the user places the document on the platen 32 and presses the start switch, the scanner 300 is driven immediately to move a first carriage 33 and a second carriage 34. Subsequently, the first carriage 33 directs light from a light source onto the document and reflects the light reflected from a surface of the document to the second carriage 34. The light is then reflected from a mirror of the second carriage 34 and enters an image reading sensor 36 via an imaging forming lens 35. Thus, the image reading sensor 36 reads an image on the document.

In parallel with the document reading, a drive motor as a driver rotates the third support roller 16 as the drive roller. The rotation of the third support roller 16 rotates the intermediate transfer belt 10 clockwise in FIG. 1. The rotation of the intermediate transfer belt 10 rotates the other two support rollers as driven rollers, namely, the first support roller 14 and the second support roller 15.

While the document is read and the intermediate transfer belt 10 is moved, drum-shaped photoconductors 40Y, 40M, 40C, and 40K are rotated in the image forming units 18Y, 18M, 18C, and 18K, respectively. Note that the photoconductors 40Y, 40M, 40C, and 40K serve as image bearers according to the present embodiment. The exposure device 21 exposes the surfaces of the photoconductors 40Y, 40M, 40C, and 40K according to image data of yellow, magenta, cyan, and black, respectively, to form electrostatic latent images thereon. The electrostatic latent images are then developed into the toner images of yellow, magenta, cyan, and black as visible toner images. Thus, a single-color toner image is formed on each of the photoconductors 40Y, 40M, 40C, and 40K.

Primary transfer devices 62Y, 62M, 62C, and 62K are disposed facing the photoconductors 40Y, 40M, 40C, and 40K, respectively, via the horizontal portion of the intermediate transfer belt 10 stretched taut between the first support roller 14 and the second support roller 15. Note that the primary transfer devices 62Y, 62M, 62C, and 62K, which include primary transfer rollers, serve as primary transfer devices according to the present embodiment. The primary transfer devices 62Y, 62M, 62C, and 62K sequentially transfer the toner images from the photoconductors 40Y, 40M, 40C, and 40K, respectively, onto the intermediate transfer belt 10 such that the toner images are superimposed one atop another, to form a composite color toner image on the intermediate transfer belt 10.

In parallel with the image forming operation described above, in the sheet feeding device 200, one of feed rollers 42 is selected and rotated to feed the transfer sheets S from one of sheet trays 44 vertically disposed in a sheet bank 43. The transfer sheets S thus fed are separated one by one by a separation roller 45. The transfer sheet S thus separated enters a conveyance passage 46 and is conveyed by at least one conveyance roller 47 toward a conveyance passage defined by internal components of the apparatus body 100. The transfer sheet S thus conveyed abuts against a registration roller pair 49, which temporarily stops the movement of the transfer sheet S. Alternatively, a bypass feed roller 50 rotates to feed the transfer sheets S from a bypass feeder 51. The transfer sheets S thus fed are separated one by one by a bypass separation roller 52. The transfer sheet S thus separated enters a bypass conveyance passage 53 and abuts against the registration roller pair 49, which temporarily stops the movement of the transfer sheet S.

Rotation of the registration roller pair 49 is timed to convey the transfer sheet S toward an area of contact, which may be referred to as a secondary transfer nip in the following description, between the intermediate transfer belt 10 and the secondary transfer device 22 such that the transfer sheet S meets the composite color toner image on the intermediate transfer belt 10 at the secondary transfer nip. The secondary transfer device 22 transfers the color toner image from the intermediate transfer belt 10 onto the transfer sheet S at the secondary transfer nip.

The secondary transfer belt 24 conveys the transfer sheet S bearing the color toner image to the fixing device 25. In the fixing device 25, the fixing belt 26 and the pressure roller 27 apply heat and pressure to the transfer sheet S to fix the transferred toner image onto the transfer sheet S. Thereafter, a switching craw 55 directs the transfer sheet S to an output roller pair 56. The output roller pair 56 outputs the transfer sheet S onto an output tray 57. Thus, the transfer sheets S lie stacked on the output tray 57. Alternatively, the switching craw 55 directs the transfer sheet S to the sheet reverse device 28. The sheet reverse device 28 reverses the transfer sheet S and guides the transfer sheet S to the secondary transfer nip at which another toner image is transferred onto a back side of the transfer sheet S. Thereafter, the output roller pair 56 outputs the transfer sheet S onto the output tray 57.

As the intermediate transfer belt cleaner 17 removes the residual toner that remains on the intermediate transfer belt 10 after the color toner image is transferred from the intermediate transfer belt 10, the intermediate transfer belt 10 is ready for the next image formation that is performed by the tandem image forming device 20. In general, the registration roller pair 49 is grounded. However, a bias may be applied to the registration roller pair 49 to remove paper dust from the transfer sheet S.

The apparatus body 100 includes a toner adhesion amount sensor 310, which is an optical sensor unit including, e.g., an optical sensor and serves as a density detection sensor or a density detector that detects the density of a toner image formed on the outer circumferential surface of the intermediate transfer belt 10. Specifically, the toner adhesion amount sensor 310 functions as a density detector that detects the density of a toner image on the intermediate transfer belt 10 to detect an amount of toner adhering to the intermediate transfer belt 10 to detect the unevenness in density of the image. The toner adhesion amount sensor 310 may be referred to as a toner image detection sensor or a toner adhesion amount detection sensor. The toner adhesion amount sensor 310 detects a toner adhesion amount of an image pattern 320 formed on the outer circumferential surface of the intermediate transfer belt 10. In other words, the toner adhesion amount sensor 310 detects an amount of toner contained in the image pattern 320 and adhering to the intermediate transfer belt 10. A detailed description of the image pattern 320 is deferred with reference to FIGS. 6A and 6B. Optionally, a facing roller 311 may be disposed facing the toner adhesion amount sensor 310 via the intermediate transfer belt 10 as illustrated in FIG. 1.

Figure 2:
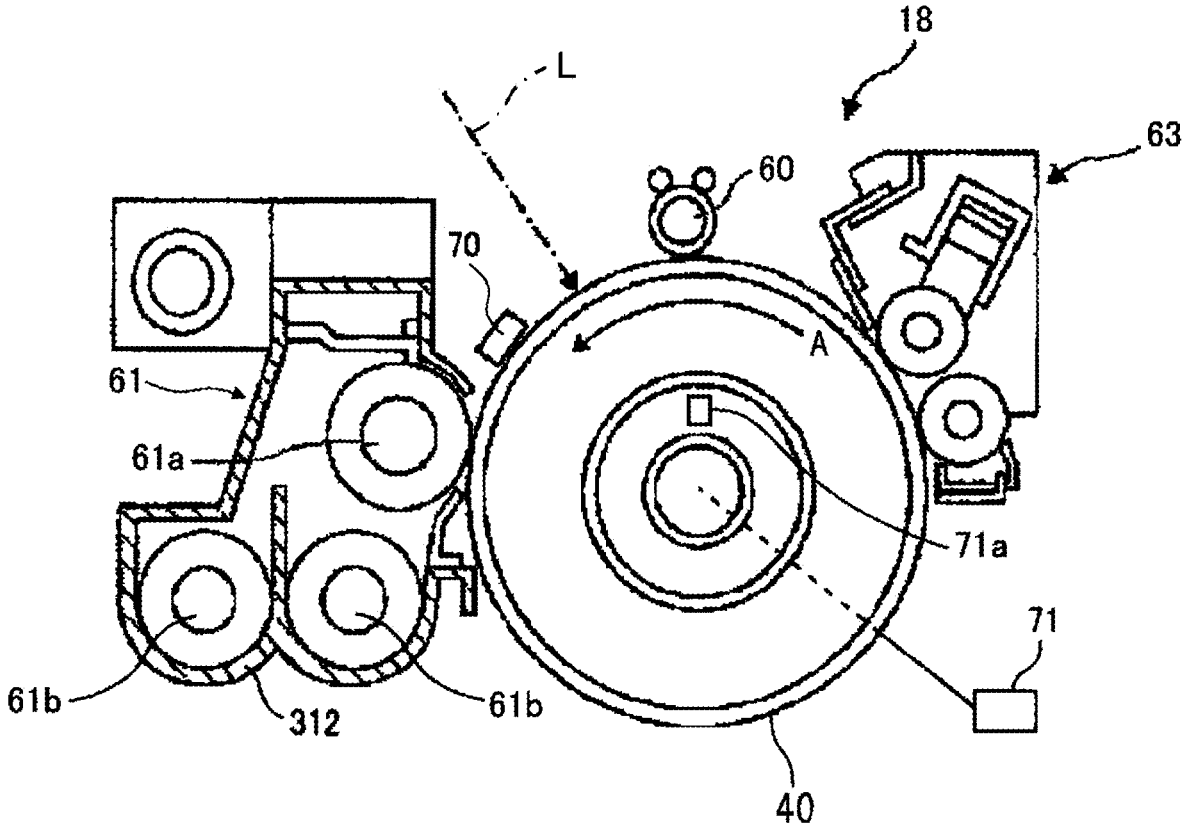
FIG. 2 is a diagram illustrating a configuration of an image forming unit of a tandem image forming device included in the image forming apparatus of FIG. 1.

FIG. 2 is a diagram illustrating a configuration of the image forming units 18 of the tandem image forming device 20 included in the image forming apparatus 1.

Since the image forming units 18 have substantially the same configuration, the suffixes Y, M, C, and K are omitted unless necessary in the following description.

As illustrated in FIG. 2, the image forming unit 18 includes, around the drum-shaped photoconductor 40, e.g., a charger 60, a potential sensor 70, a developing device 61, a photoconductor cleaner 63, and a discharger.

The photoconductor 40 is rotated in a direction of rotation A by a photoconductor drive motor 72 (see FIG. 5) serving as an image bearer driver that rotates an image bearer according to the present embodiment. The surface of the photoconductor 40 is uniformly charged by the charger 60 and is exposed by exposure light L from the exposure device 21 controlled according to a color image signal generated according to image data of a document and output by the scanner 300. Thus, an electrostatic latent image is formed on the surface of the photoconductor 40. Specifically, color image signals are generated according to the image data by the scanner 300 and subjected to image processing such as color conversion processing performed by an image processor. Thus, the color image signals are output to the exposure device 21 as image signals for the colors of yellow, magenta, cyan, and black. The exposure device 21 converts the image signals from the image processor into optical signals and scans to expose the uniformly charged surfaces of the photoconductors 40 according to the optical signals, thus forming electrostatic latent images on the photoconductors 40.

The developing device 61 includes a developing roller 61*a* as a developer bearer. A developing bias is applied to the developing roller 61*a* to form a developing potential that is a potential difference between the electrostatic latent image on the photoconductor 40 and the developing roller 61*a*. The developing potential transfers the toner on the developing roller 61*a* from the developing roller 61*a* to the electrostatic latent image on the photoconductor 40. Thus, the electrostatic latent image is developed to form the toner image. The developing device 61 further includes a developer conveying screw 61*b* in a developer conveying portion of the developing device 61 and a toner density sensor 312 at the bottom of the developer conveying portion to detect the density of toner contained in the developer.

The toner image formed on the photoconductor 40 is primarily transferred onto the intermediate transfer belt 10 by the primary transfer device 62. After the toner image is transferred, the photoconductor cleaner 63 removes the residual toner from the surface of the photoconductor 40. The discharger discharges the surface of the photoconductor 40 so that the photoconductor 40 is ready for the next image formation.

The exposure device 21 and the chargers 60Y, 60M, 60C, and 60K in the image forming apparatus 1 having the configuration described above function as latent image forming devices that form electrostatic latent images on the surfaces of the photoconductors 40Y, 40M, 40C, and 40K. In addition, the exposure device 21, the chargers 60Y, 60M, 60C, and 60K, and the developing devices 61Y, 61M, 61C, and 61K function as toner image forming devices that form toner images on the surfaces of the photoconductors 40Y, 40M, 40C, and 40K.

In the image forming apparatus 1 according to the present embodiment, the image forming units 18Y, 18M, and 18C include reference position detection sensor 71Y, 71M, 71C, and 71K, respectively. Each of the reference position detection sensor 71Y, 71M, 71C, and 71K serves as a rotation reference position detector that detects a detection target 71*a* located at a rotation reference position of the photoconductor 40 according to the present embodiment. The reference position detection sensor 71 optically detects the detection target 71*a* disposed on the photoconductor 40. The reference position detection sensor 71 includes a light emitting element and a light receiving element facing each other, for example. The reference position detection sensor 71 detects the rotation reference position of the photoconductor 40 when the detection target 71*a* disposed on the photoconductor 40 passes between the light emitting device and the light receiving element while blocking light.

Figure 3A:
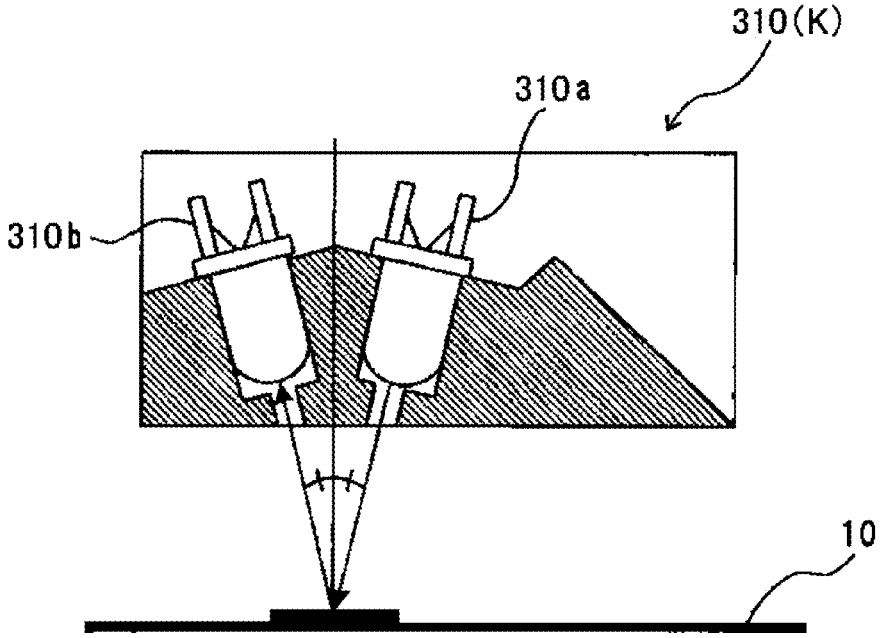
FIG. 3A is a diagram illustrating a configuration of a toner adhesion amount sensor as an image density detector that detects the density of a black toner image in the image forming apparatus of FIG. 1.
Figure 3B:
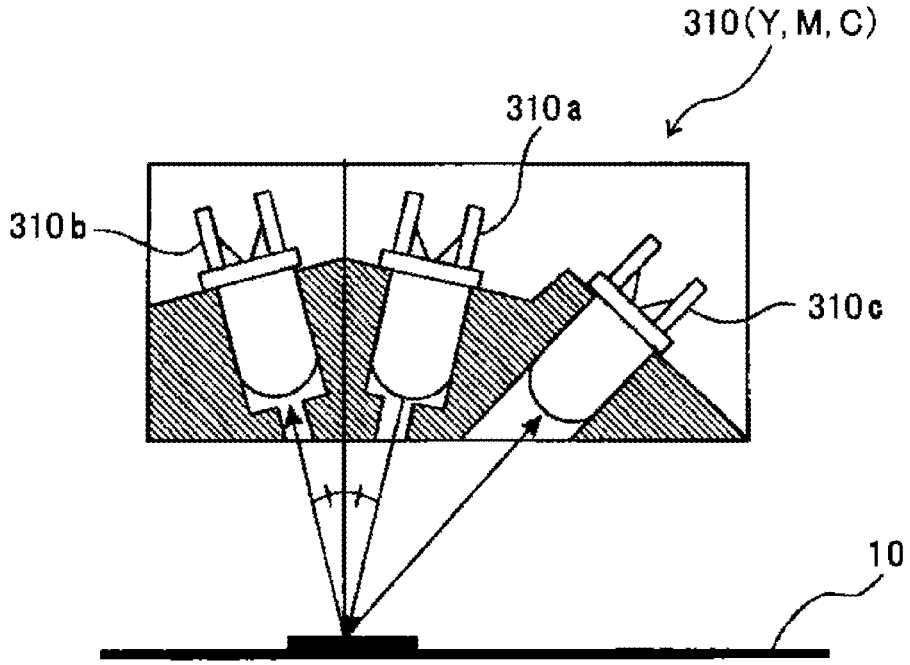
FIG. 3B is a diagram illustrating a configuration of another toner adhesion amount sensor that detects the density of a color toner image other than the black toner image.

FIGS. 3A and 3B are diagrams illustrating respective configurations of the toner adhesion amount sensors 310 serving as image density detectors that detect the density of toner images in the image forming apparatus 1 according to the present embodiment. Specifically, FIG. 3A illustrates a configuration of a black toner adhesion amount sensor 310 (K) that is suitable for detecting the density of a black toner image. FIG. 3B illustrates a configuration of a color toner adhesion amount sensor 310 (Y, M, C) that is suitable for detecting the density of color toner images other than the black toner image.

As illustrated in FIG. 3A, the black toner adhesion amount sensor 310 (K) includes a light emitting element 310*a*, which includes, e.g., a light emitting diode (LED), and a light receiving element 310*b* that receives specularly reflected light. The light emitting element 310*a* emits light onto the intermediate transfer belt 10. The light thus emitted is reflected from the intermediate transfer belt 10. The light receiving element 310*b* receives specularly reflected light of the light reflected from the intermediate transfer belt 10.

On the other hand, as illustrated in FIG. 3B, the color toner adhesion amount sensor 310 (Y, M, C) includes the light emitting element 310*a*, which includes, e.g., an LED as described above, a light receiving element 310*b* that receives specularly reflected light, and a light receiving element 310*c* that receives diffusely reflected light. Similar to the light emitting element 310*a* of the black toner adhesion amount sensor 310 (K), the light emitting element 310*a* of the color toner adhesion amount sensor 310 (Y, M, C) emits light onto the intermediate transfer belt 10. The light thus emitted is reflected from the intermediate transfer belt 10. The light receiving element 310*b* serving as a specularly-reflected light receiving element receives specularly reflected light of the light reflected from the intermediate transfer belt 10. The light receiving element 310*c* serving as a diffusely-reflected light receiving element receives diffusely reflected light of the light reflected from the intermediate transfer belt 10.

In the present embodiment, the light emitting elements 310*a* is, e.g., an infrared light emitting diode made of gallium arsenide (GaAs) that emits light having a peak wavelength of about 950 nm. Each of the light receiving elements 310*b* and 310*c* is, e.g., a silicon (Si) phototransistor having a peak light-receiving sensitivity of about 800 nm. In another embodiment, however, the light emitting element 310*a* may emit light having a peak wavelength different from the peak wavelength described above. Similarly, the light receiving elements 310*b* and 310*c* may have a peak light-receiving sensitivity different from the peak light-receiving sensitivity described above. The black toner adhesion amount sensor 310 (K) and the color toner adhesion amount sensor 310 (Y, M, C) are disposed at a distance (as a detection distance) of, e.g., about 5 mm from the outer circumferential surface of the intermediate transfer belt 10 on which a toner image as a detection target is transferred.

In the image forming apparatus 1 of the present embodiment, the toner adhesion amount sensor 310 is disposed near the intermediate transfer belt 10 to detect, as an image density, the density of a toner image in a given image pattern transferred from each of the photoconductors 40Y, 40M, 40C, and 40K onto the intermediate transfer belt 10. An image forming condition is determined based on the image density (or the toner adhesion amount) detected on the intermediate transfer belt 10. In another embodiment, the toner adhesion amount sensor 310 may be disposed near each of the photoconductors 40Y, 40M, 40C, and 40K. In this case, the densities of the toner images formed on the photoconductors 40Y, 40M, 40C, and 40K may be directly detected without using the intermediate transfer belt 10. In yet another embodiment, the toner adhesion amount sensor 310 may be disposed near a transfer conveyor belt that conveys the transfer sheet S. In this case, the toner images may be transferred from the photoconductors 40Y, 40M, 40C, and 40K onto the transfer conveyor belt to detect the image densities.

Outputs from the black toner adhesion amount sensor 310 (K) and the color toner adhesion amount sensor 310 (Y, M, C) are converted into toner adhesion amounts by an adhesion amount conversion algorithm.

As the adhesion amount conversion algorithm, an algorithm similar to a typical algorithm may be used.

The photoconductor 40 serving as an image bearer used in the image forming apparatus 1 has a cylindrical shape, which is not a complete cylindrical shape. Specifically, the photoconductor 40 has a cylindrical shape with deflection due to variations in components generated during formation of the photoconductor 40. Such deflection due to variations in components may cause a periodic fluctuation in image density on an image with one rotation of a photoconductor defined as one period, during image formation in an image forming apparatus.

If yellow, magenta, and cyan have different phases of the periodic fluctuations in image density, a full-color image may have a periodic fluctuation in tint, thus degrading the image quality. Such a tint is generated in a color portion of the full-color image in which yellow, magenta, and cyan toners are superimposed one atop another.

Figure 4A:
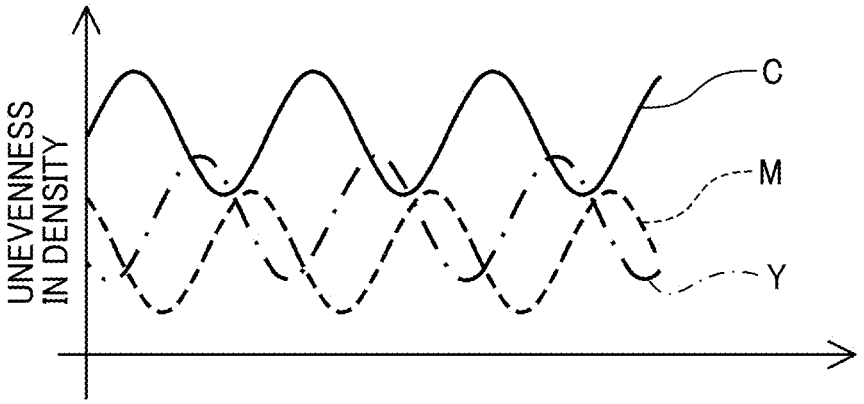
FIG. 4A is a graph illustrating periodic fluctuations in image density of yellow (Y), magenta (M), and cyan (C)
Figure 4B:
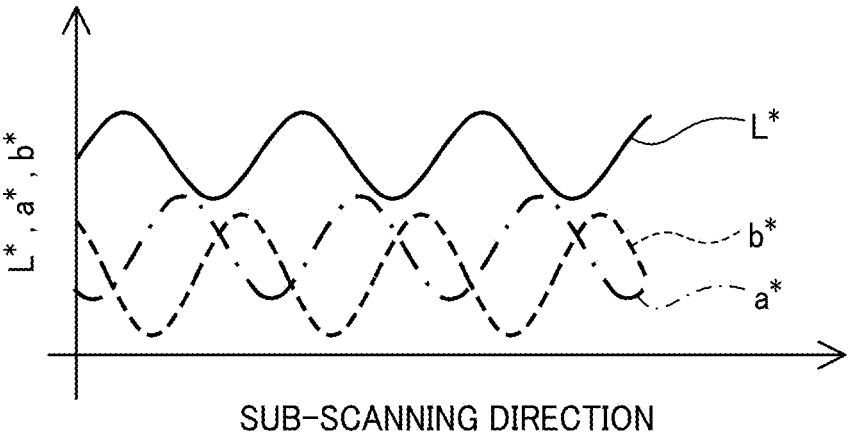
FIG. 4B is a graph illustrating lightness L* and chromaticities a* and b* in a sub-scanning direction of a 3C gray image formed by superimposing yellow, magenta, and cyan images one atop another.

FIG. 4A is a graph illustrating periodic fluctuations in image density of yellow, magenta, and cyan. FIG. 4B is a graph illustrating lightness L* and chromaticities a* and b* in a sub-scanning direction of a 3C gray image formed by superimposing yellow, magenta, and cyan images one atop another.

As illustrated in FIG. 4A, when a color image is formed with different phases of the periodic fluctuations in image density of yellow, magenta, and cyan, the lightness L* and the chromaticities a* and b* of the image periodically fluctuate as illustrated in FIG. 4B. In particular, the periodic fluctuations of the chromaticities a* and b* mean that the tint of the color image periodically fluctuates. Since such a periodic fluctuation in tint has a relatively high apparent sensitivity, the color image may often appear as a defective image. Although black may have a periodic fluctuations in image density with one rotation of a photoconductor as one period, the chromaticities a* and b* do not periodically fluctuate.

Therefore, in the image forming apparatus 1 of the present embodiment, yellow, magenta, and cyan have identical phases of the periodic fluctuations in image density. As a result, the images are superimposed one atop another such that respective portions of the images having a relatively low image density overlap each other and that respective portions of the images having a relatively high image density overlap each other. Accordingly, the density difference between the colors is reduced at each position in the sub-scanning direction. Thus, the image forming apparatus 1 of the present embodiment reduces the amplitude of the periodic fluctuations of the chromaticities a* and b* and the changes of tint, to enhance the image quality.

Figure 5:
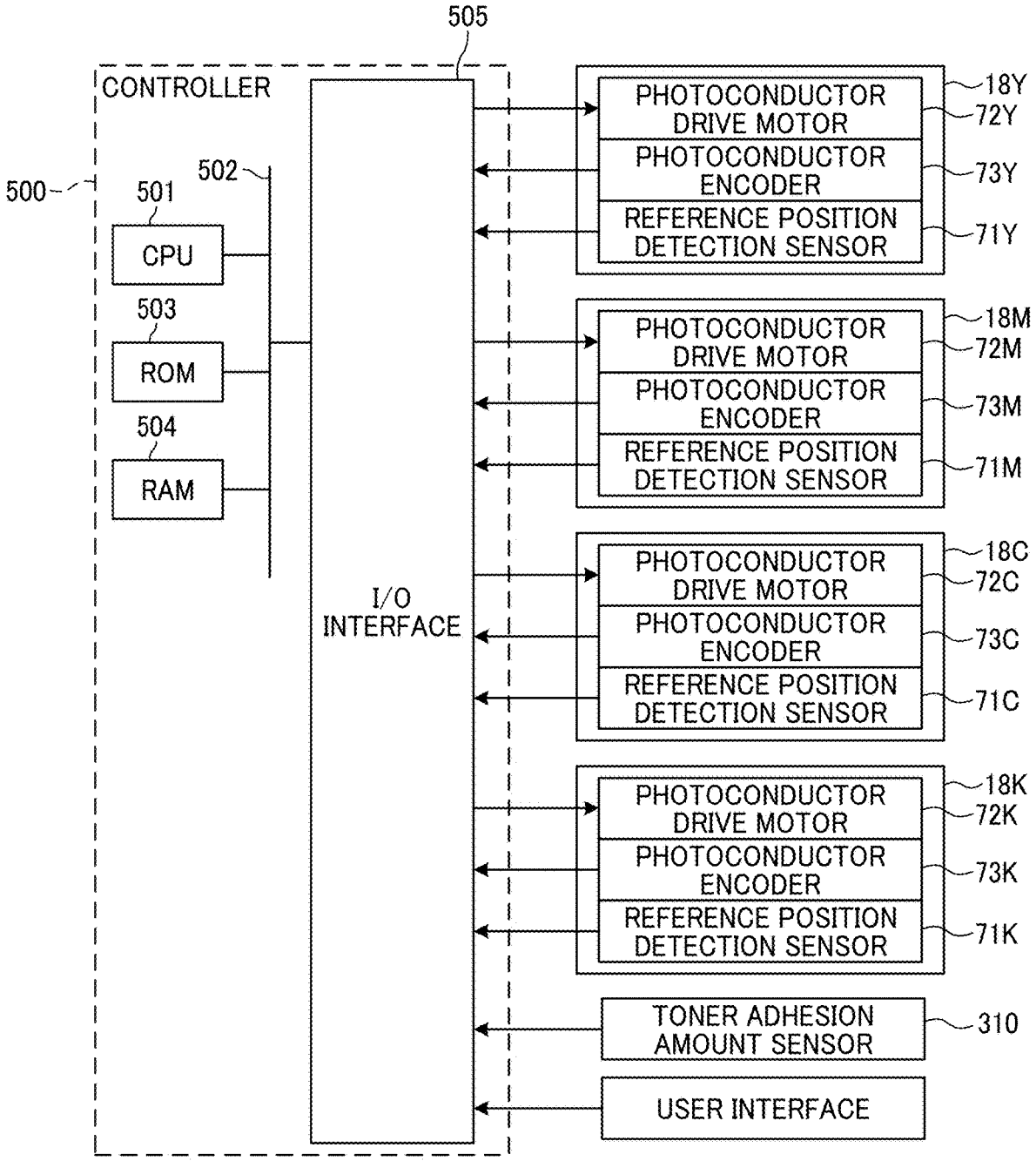
FIG. 5 is a block diagram of components of the image forming apparatus relative to phasing control of periodic fluctuations in image density.

FIG. 5 is a block diagram of components of the image forming apparatus 1 relative to phasing control of periodic fluctuations in image density.

The image forming apparatus 1 includes a controller 500 as a computer device such as a microcomputer. The controller 500 controls, e.g., the photoconductor drive motors 72Y, 72M, 72C, and 72K disposed in the image forming units 18Y, 18M, 18C, and 18K, respectively, according to image information that is input, to perform phasing control of periodic fluctuations in image density.

The controller 500 includes a central processing unit (CPU) 501. The controller 500 further includes a read only memory (ROM) 503 and a random access memory (RAM) 504 serving as storage devices connected to the CPU 501 via a bus line 502. The controller 500 further includes an input/output (I/O) interface 505. The CPU 501 executes a control program, which is a computer program installed in advance, to perform various calculations or control driving of components. The ROM 503 stores in advance computer programs and fixed data such as control data. The RAM 504 functions as a work area for storing various kinds of data such that the various kinds of data are rewritable.

The toner adhesion amount sensor 310 is connected to the controller 500 via the I/O interface 505. The toner adhesion amount sensor 310 sends detected information to the controller 500.

The ROM 503 or the RAM 504 stores, e.g., a conversion table that stores information related to conversion of an output value of the toner adhesion amount sensor 310 into a toner adhesion amount per unit area.

The image forming units 18Y, 18M, 18C, and 18K respectively include photoconductor encoders 73Y, 73M, 73C, and 73K to detect the speed of the photoconductors 40Y, 40M, 40C, and 40K. The photoconductor drive motor 72, the photoconductor encoder 73, and the reference position detection sensor 71 of each of the image forming units 18Y, 18M, 18C, and 18K are connected to the controller 500 via the I/O interface 505. A user interface is also connected to the controller 500 via the I/O interface 505.

The controller 500 controls the photoconductor drive motor 72 based on the results of detection performed by the reference position detection sensor 71 and the photoconductor encoder 73 of each of the image forming units 18Y, 18M, and 18C, to perform the phasing control of periodic fluctuations in image density as alignment control.

Note that the controller 500 may include, e.g., an integrated circuit (IC) as a semiconductor circuit element manufactured for control in the image forming apparatus 1, instead of a computer device such as a microcomputer.

Figure 6A:
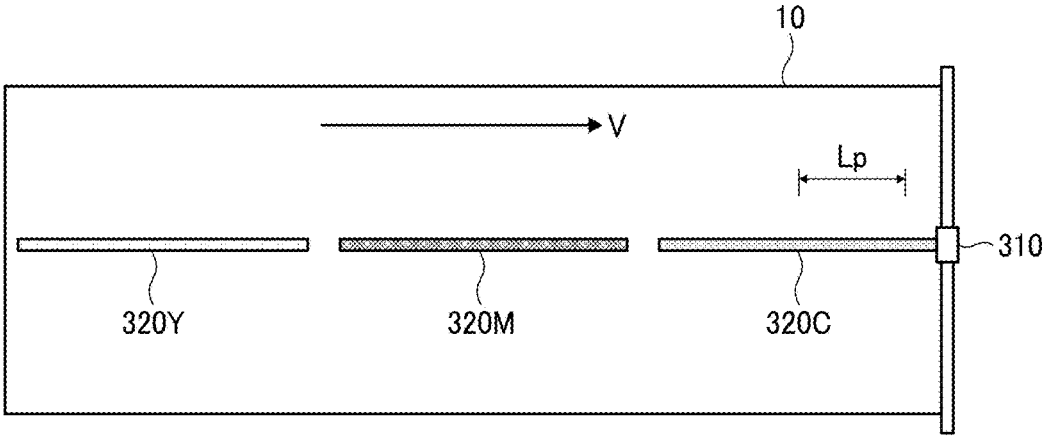
FIG. 6A is a diagram illustrating an example of an image pattern formed to acquire periodic fluctuations in image density of yellow, magenta, and cyan.
Figure 6B:
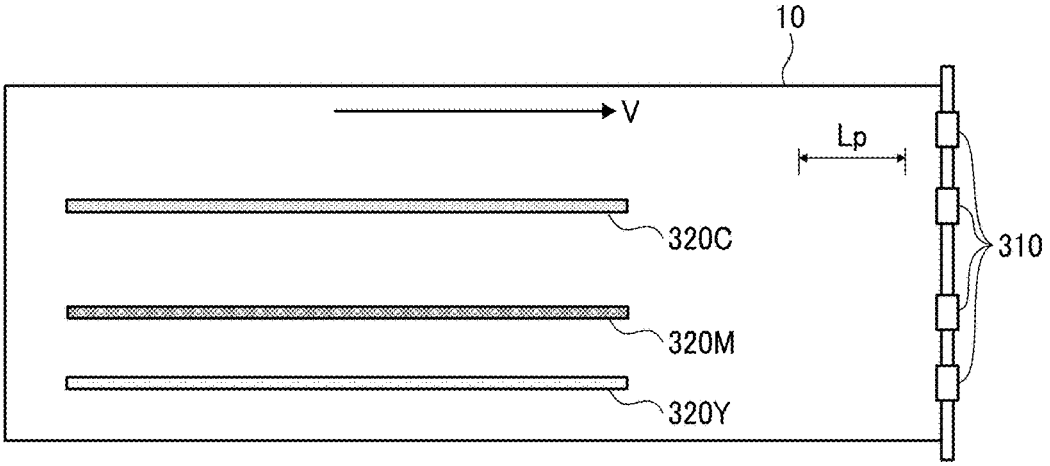
FIG. 6B is a diagram illustrating another example of the image pattern formed to acquire periodic fluctuations in image density of yellow, magenta, and cyan.

Referring now to FIGS. 6A and 6B, a description is given of acquisition of periodic fluctuations in image density of yellow, magenta, and cyan.

FIGS. 6A and 6B are diagrams illustrating examples of an image pattern formed to acquire periodic fluctuations in image density of yellow, magenta, and cyan.

Specifically, FIG. 6A is a diagram illustrating an image pattern that is detected simply with the toner adhesion amount sensor 310 (central sensor head) disposed at the center in a width direction of the intermediate transfer belt 10.

In the present example, belt-like halftone image patterns 320Y, 320M, and 320C for the colors of yellow, magenta, and cyan, respectively, extending in a belt moving direction V are sequentially formed as toner images in a detection area of the toner adhesion amount sensor 310 (central sensor head). The toner adhesion amount sensor 310 detects the toner adhesion amount (or unevenness in density of toner image) of the belt-like halftone image patterns 320Y, 320M, and 320C. The length of each of the image patterns 320Y, 320M, and 320C in the belt moving direction V is at least one cycle of a circumferential length Lp of the photoconductor 40.

FIG. 6B is a diagram illustrating an image pattern that is detected with the plurality of toner adhesion amount sensors 310 (sensor heads). In the present example, the belt-like halftone image patterns 320Y, 320M, and 320C extending in the belt moving direction V are formed as toner images in the respective detection areas of the toner adhesion amount sensors 310 (sensor heads). The toner adhesion amount sensors 310 detect the unevenness in density of the respective toner images, in other words, the respective belt-like halftone image patterns 320Y, 320M, and 320C. In this case, similarly to the example illustrated in FIG. 6A, each of the image patterns 320Y, 320M, and 320C is a belt-like halftone pattern and has a length of at least one cycle of the circumferential length Lp of the photoconductor 40.

The image patterns 320 thus formed are halftone patterns with high visibility for, e.g., a user. The image patterns 320 as halftone patterns reduces a variation in tint of the halftone, as most desired.

In another embodiment, the image patterns 320 may be solid patterns. Since the solid pattern has a relatively large deflection in adhesion amount, which is described later as an amplitude A, the image patterns 320 as solid patterns may be advantageous for accurate detection of a phase θ, which is described later.

The image patterns 320 are formed while the reference position detection sensors 71Y, 71M, and 71C detect the rotation reference positions (specifically, the positions of the detection targets 71*a*) of the photoconductors 40Y, 40M, and 40C, respectively.

Specifically, as the exposure device 21 starts writing the latent images of the image patterns 320, the reference position detection sensors 71Y, 71M, and 71C detect the detection targets 71*a* located at the respective rotation reference positions. Alternatively, the exposure device 21 may start writing the latent images of the image patterns 320 in response to the reference position detection sensors 71Y, 71M, and 71C detecting the respective detection targets 71*a*, to acquire the relationship between the periodic fluctuations in image density and the rotation reference positions of the photoconductors 40.

Figure 7:
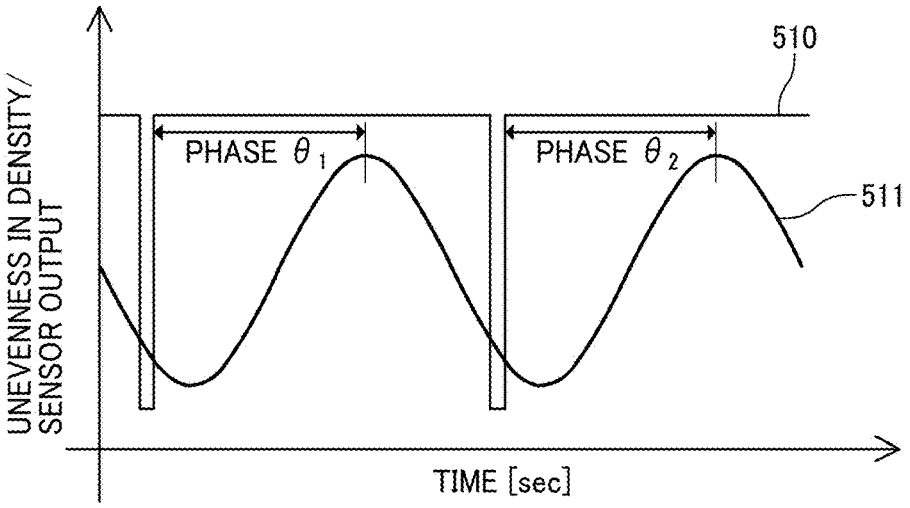
FIG. 7 is a graph illustrating an example of measurement of a photoconductor rotation reference position detection signal and a toner adhesion amount detection signal as an output signal from the toner adhesion amount sensor detecting the image pattern illustrated in FIG. 6A or 6B.

FIG. 7 is a graph illustrating an example of measurement of a photoconductor rotation reference position detection signal 510 and a toner adhesion amount detection signal 511 as an output signal from the toner adhesion amount sensor 310 detecting the image pattern 320 illustrated in FIG. 6A or 6B.

As illustrated in FIG. 7, the toner adhesion amount detection signal 511 fluctuates with the same period as the period of the photoconductor rotation reference position detection signal 510.

In the image forming apparatus 1 of the present embodiment, the controller 500 segments, in the signal processing, the toner adhesion amount detection signal 511 from the toner adhesion amount sensor 310 by one rotation period of the photoconductor 40, which may be referred to as a photoconductor cycle. In order to segment the toner adhesion amount detection signal 511, the controller 500 uses the photoconductor rotation reference position detection signal 510 from the reference position detection sensor 71. For example, in FIG. 7, the controller 500 takes out the toner adhesion amount detection signal 511 for one photoconductor cycle with a detection end portion, which is a portion where the output is recovered, of the detected photoconductor rotation reference position detection signal 510 as a time 0. Accordingly, a plurality of periodic fluctuations in image density is acquired for one photoconductor cycle, in other words, for one cycle of rotation of the photoconductor 40.

The controller 500 calculates respective amplitudes A1 and A2 of the toner adhesion amount detection signal 511 for several photoconductor cycles, in other words, for several cycles of rotation of the photoconductor 40. Then, the controller 500 obtains phases (01, 02, and maybe more) for several photoconductor cycles, in other words, for several cycles of rotation of the photoconductor 40 from the calculated amplitudes A1 and A2 and the detection end portion of the photoconductor rotation reference position detection signal 510. The controller 500 averages the obtained plurality of phases (θ1, θ2, and maybe more) to obtain a phase θ of the periodic fluctuations in image density. The obtained phase θ of the periodic fluctuations in image density is stored in a nonvolatile memory and used for phasing control described later.

As illustrated in FIG. 7, a phase θ of a periodic fluctuation in image density is a phase difference between the detection end portion of the photoconductor rotation reference position detection signal 510 and a peak portion of the toner adhesion amount detection signal 511.

In one embodiment, the phase θ and the amplitude A of the toner adhesion amount detection signal 511 may be calculated by averaging the toner adhesion amount detection signals 511 for several photoconductor cycles and generating data of the toner adhesion amount detection signal 511 for one photoconductor cycle. In the example illustrated in FIG. 7, the phase information and the amplitude of the toner adhesion amount detection signal 511 output from the toner adhesion amount sensor 310 are described as image density unevenness information. However, the amplitude A and the phase θ may be obtained by converting the toner adhesion amount detection signal 511 output from the toner adhesion amount sensor 310 into the toner adhesion amount.

The control for acquiring periodic fluctuations in image density is performed, for example, immediately after the photoconductor 40 is set. For example, the control for acquiring periodic fluctuations in image density is performed when the photoconductor 40 is initially set, when the photoconductor 40 is replaced, when the photoconductor 40 is removed, or when the photoconductor 40 is attached.

When the photoconductor 40 is removed from the apparatus body 100, occurrences of the periodic fluctuation in image density per photoconductor cycle may change with a relatively high possibility. In addition, when the photoconductor 40 is replaced, the periodic fluctuation in image density for one rotation period of the photoconductor 40 changes because a new photoconductor 40 has a different deflection characteristic from the deflection characteristic of the photoconductor 40 used so far. Further, since the relationship between the deflection characteristic of the photoconductor 40 and the detection target 71*a* changes, the phase θ of the periodic fluctuation in image density also changes.

Furthermore, even in a case where the photoconductor 40 is simply removed and attached for maintenance, the condition of the photoconductor 40 attached may change, in other words, the deviation in the axis of the photoconductor 40 and the rotational axis direction of the photoconductor 40 may change. For this reason, even when the photoconductor 40 is simply removed and attached, the phase θ of the periodic fluctuation in image density is to be calculated again. For the reasons described above, the control for acquiring periodic fluctuations in image density is performed immediately after the photoconductor 40 is set, to obtain the phase θ.

The control for acquiring periodic fluctuations in image density may be performed to obtain the phase θ when the environmental conditions change in the image forming apparatus 1. In particular, in response to a change in a temperature condition as one of the environmental conditions, a tube of the photoconductor 40 expands or contracts according to the thermal expansion coefficient of the tube of the photoconductor 40. Since a change in the outer profile of the photoconductor 40 changes the fluctuation state of the developing gap, the periodic fluctuation of the image density may also change. In order to cope with this change, the control for acquiring control for acquiring periodic fluctuations in image density is preferably executed to obtain the phase θ when the environmental conditions change. For example, a temperature change of N degrees Celsius or more from the previous the control for acquiring periodic fluctuations in image density may be determined as a trigger for executing the control for acquiring periodic fluctuations in image density. The control for acquiring periodic fluctuations in image density may be similarly executed at interval of printing a certain number of sheets.

Now, a description is given of the phasing control of periodic fluctuations in image density.

The image forming apparatus 1 of the present embodiment matches the phases of periodic fluctuations in image density with reference to yellow.

The controller 500 calculates a target phase difference $\theta_{YM}$ between a photoconductor rotation reference position detection signal for yellow and a photoconductor rotation reference position detection signal for magenta when yellow, magenta, and cyan have identical phases of the periodic fluctuations in image density. In addition, the controller 500 calculates a target phase difference $\theta_{YC}$ between the photoconductor rotation reference position detection signal for yellow and a photoconductor rotation reference position detection signal for cyan.

The target phase difference $\theta_{YM}$ is calculated by Equation (1) below, for example.

$$\theta_{YM}=V(\theta_Y-\theta_M)+(L_Y+L1-L_M), \quad (1)$$

where $L_Y$ represents a moving distance of the photoconductor 40Y from a developing position to a primary transfer position, $L_M$ represents a moving distance of the photoconductor 40M from a developing position to a primary transfer position, L1 represents a remainder obtained when a pitch between the photoconductors 40Y and 40M (specifically, a distance between the primary transfer position of the photoconductor 40Y to the primary transfer position of the photoconductor 40M) is divided by the circumferential length of the photoconductor 40, $\theta_Y$ represents a phase of the periodic fluctuation in image density of yellow, $\theta_M$ represents a phase of the periodic fluctuation in image density of magenta, and V represents a rotational speed of the photoconductor 40.

The target phase difference $\theta_{YC}$ is calculated by Equation (2) below, for example.

$$\theta_{YC}=|V(\theta_Y-\theta_C)|+(L_Y+L2-L_C), \quad (2)$$

where $L_C$ represents a moving distance of the photoconductor 40C from a developing position to a primary transfer position, L2 represents a remainder obtained when a pitch between the photoconductors 40Y and 40C (specifically, a distance between the primary transfer position of the photoconductor 40Y to the primary transfer position of the photoconductor 40C) is divided by the circumferential length of the photoconductor 40, and $\theta_C$ represents a phase of the periodic fluctuation in image density of cyan.

When the pitch between the photoconductors 40 is an integral multiple of the circumferential length of the photoconductor 40 and the photoconductors 40Y, 40M, and 40C have the same moving distance from the developing position to the primary transfer position, the target phase difference $\theta_{YM}$ and the target phase difference $\theta_{YC}$ are calculated as follows, for example. In other words, the target phase difference $\theta_{YM}$ and the target phase difference $\theta_{YC}$ are calculated simply with the phases $\theta_Y$, $\theta_M$, and $\theta_C$ of the periodic fluctuations in image density obtained as a result of execution of the control for acquiring periodic fluctuations in image density.

When a value calculated by Equation (1) or Equation (2) exceeds the circumferential length of the photoconductor 40, the circumferential length of the photoconductor 40 is subtracted so that the value is equal to or less than the circumferential length of the photoconductor 40.

In the present embodiment, the target phase differences $\theta_{YM}$ and $\theta_{YC}$ are calculated at the time of the phasing control of periodic fluctuations in image density. Alternatively, the target phase differences $\theta_{YM}$ and $\theta_{YC}$ may be calculated at the time of the control for acquiring periodic fluctuations in image density and stored in a nonvolatile memory.

Next, the controller 500 controls the photoconductor drive motors 72Y, 72M, and 72C to drive the photoconductors 40Y, 40M, and 40C at the same rotational speed based on the results of detection performed by the photoconductor encoders 73Y, 73M, and 73C, respectively. Then, the controller 500 obtains an actual phase difference $\theta R_{YM}$ between the photoconductor rotation reference position detection signal for yellow and the photoconductor rotation reference position detection signal for magenta. In addition, the controller 500 obtains an actual phase difference $\theta R_{YC}$ between the photoconductor rotation reference position detection signal for yellow and the photoconductor rotation reference position detection signal for cyan.

For example, the phase difference $\theta R_{YM}$ is obtained from the rotational speed V of the photoconductor 40 and a period of time from when the reference position detection sensor 71Y detects the detection target 71*a* located at the rotation reference position to when the reference position detection sensor 71M detects the detection target 71*a* located at the rotation reference position.

In order to obtain the phase difference $\theta R_{YC}$, measured is a period of time from when the reference position detection sensor 71Y detects the detection target 71*a* located at the rotation reference position to when the reference position detection sensor 71C detects the detection target 71*a* as the rotation reference position. The phase difference $\theta R_{Yc}$ is obtained from the rotational speed V of the photoconductor 40 and the measured period of time. Note that the periods of time described above may be measured a plurality of times to obtain respective averages of the measured periods of time. The phase differences $\theta R_{YM}$ and $\theta R_{YC}$ may be obtained from the respective averages.

Next, the controller 500 subtracts the obtained phase difference $\theta R_{YM}$ from the target phase difference $\theta_{YM}$ to calculate a phase shift amount $Z_{YM}$. Similarly, the controller 500 subtracts the obtained phase difference $\theta R_{YC}$ from the target phase difference $\theta_{YC}$ to calculate a phase shift amount $Z_{YC}$. In the following description, the phase shift amount may be referred to as an adjustment amount. Similarly, the phase shift amount (adjustment amount) $Z_{YC}$ is calculated from the obtained phase difference $\theta R_{YC}$ and the target phase difference $\theta_{YC}$, obtained by Equation (2) above, between the photoconductor rotation reference position detection signal for cyan and the photoconductor rotation reference position detection signal for yellow when the phase of the periodic fluctuation in image density of yellow matches the phase of the periodic fluctuation in image density of cyan.

The controller 500 controls the photoconductor drive motors 72Y, 72M, 72C based on the calculated phase shift amounts $Z_{YM}$ and $Z_{YC}$ to rotate the photoconductors 40Y, 40M, and 40C at a given rotational speed for a predetermined specific period of time, thus matching the phases of the periodic fluctuations in image density of yellow, magenta, and cyan.

A rotational speed $V_M$ of the photoconductor 40M and a rotational speed $V_C$ of the photoconductor 40C during the phasing control are obtained by Equations (3) and (4) below, respectively, for example.

$$V_M=V_Y+(Z_{YM}/T) \quad (3)$$

$$V_C=V_Y+(Z_{YC}/T) \quad (4)$$

In Equations (3) and (4), $V_Y$ represents a rotational speed of the photoconductor 40Y and T represents the specific period of time described above.

As is clear from Equations (3) and (4), when the calculated phase shift amounts $Z_{YM}$ and $Z_{YC}$ are negative, the photoconductors 40M and 40C are decelerated relative to the rotational speed $V_Y$ of the photoconductor 40Y. By contrast, when the calculated phase shift amounts $Z_{YM}$ and $Z_{YC}$ are positive, the photoconductors 40M and 40C are accelerated relative to the rotational speed $V_Y$ of the photoconductor 40Y.

Figure 8:
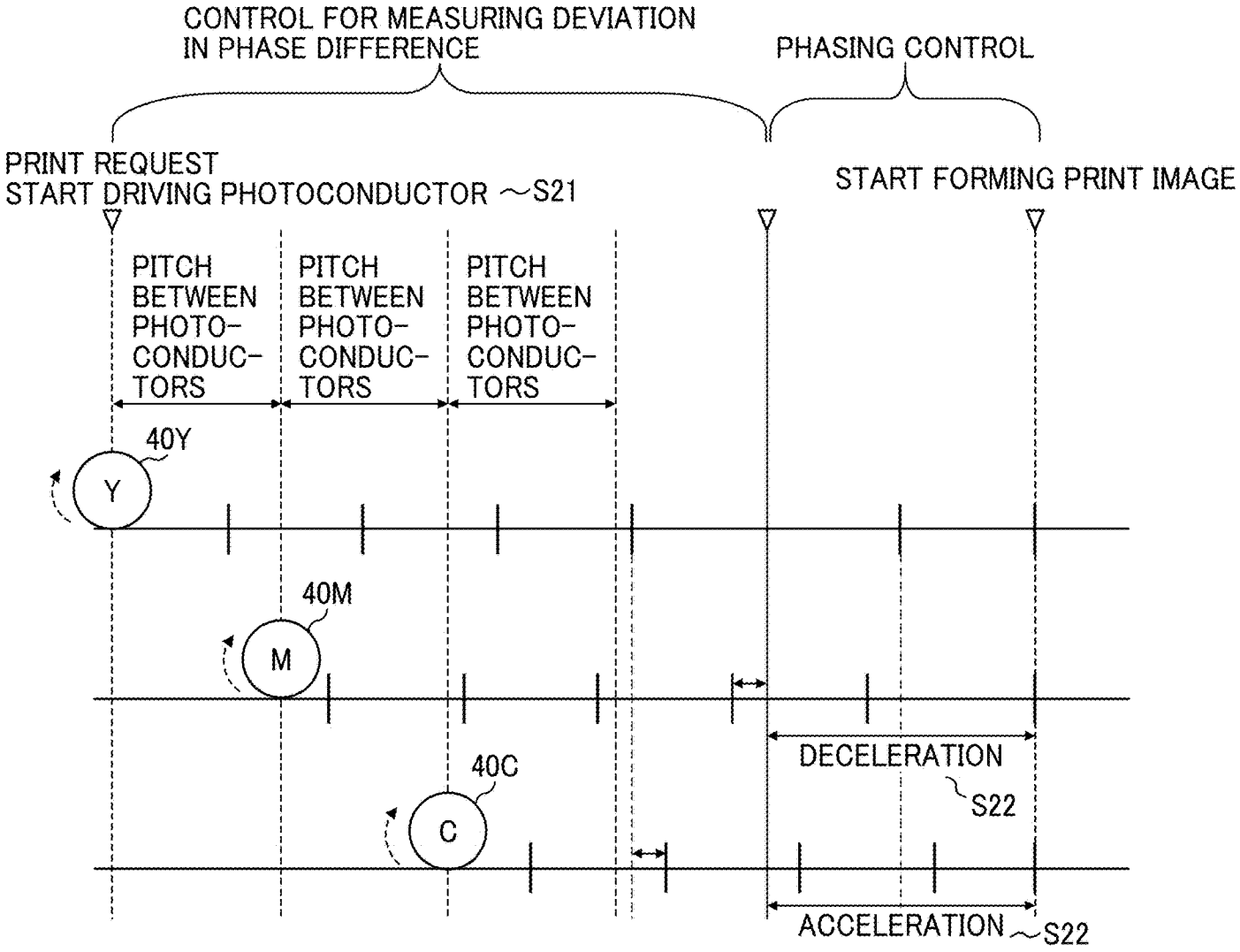
FIG. 8 is a sequence diagram illustrating an example of phasing control of periodic fluctuations in image density.

FIG. 8 is a sequence diagram illustrating an example of the phasing control of periodic fluctuations in image density.

Figure 9A:
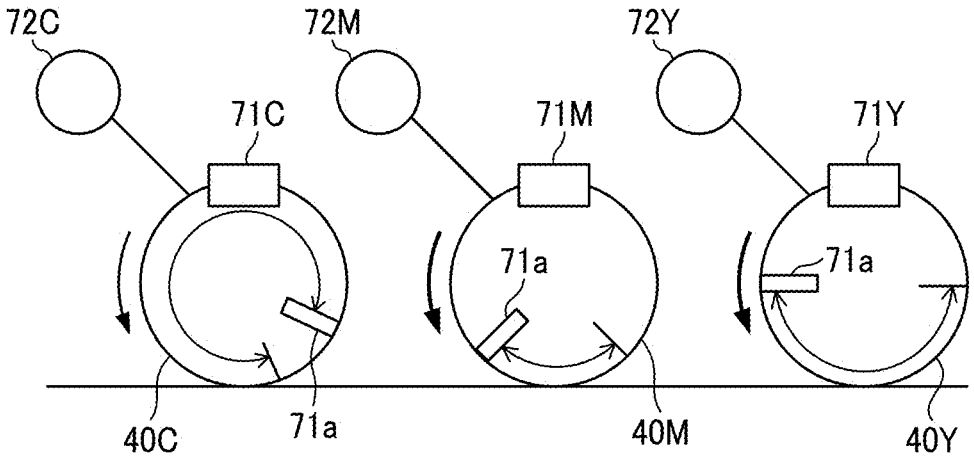
FIG. 9A is a diagram illustrating the relative rotational positions of photoconductors for yellow, magenta, and cyan before the phasing control of periodic fluctuations in image density.
Figure 9B:
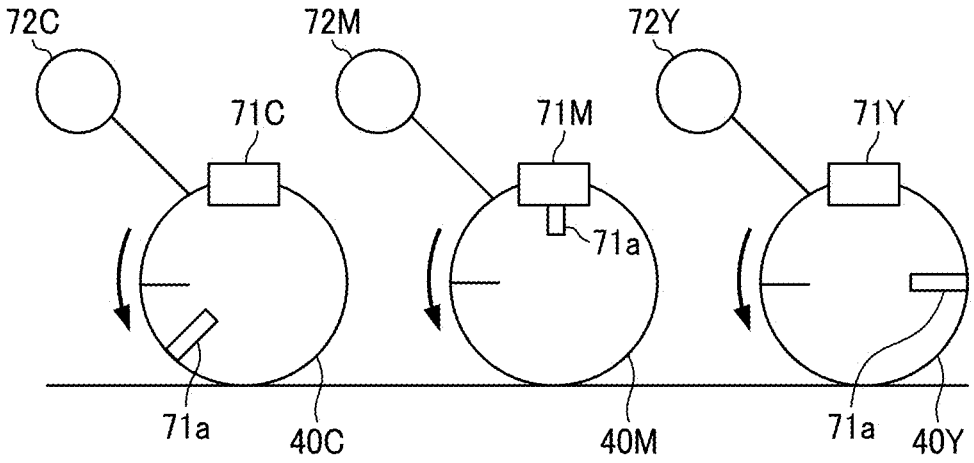
FIG. 9B is a diagram illustrating the relative rotational positions of the photoconductors for yellow, magenta, and cyan after the phasing control of periodic fluctuations in image density.

FIG. 9A is a diagram illustrating the relative rotational positions of the photoconductors 40Y, 40M, and 40C before the phasing control of periodic fluctuations in image density, in other words, before the respective rotational speeds of the photoconductors 40Y, 40M, and 40C are adjusted. FIG. 9B is a diagram illustrating the relative rotational positions of the photoconductors 40Y, 40M, and 40C after the phasing control of periodic fluctuations in image density, in other words, after the respective rotational speeds of the photoconductors 40Y, 40M, and 40C are adjusted. Note that FIGS. 9A and 9B illustrate the pitch between the photoconductors 40 as an integral multiple of the circumferential length of the photoconductor 40.

As illustrated in FIG. 8, in step S21, the controller 500 drives the photoconductors 40 at a given time and measures the deviation in phase difference. In the present example, the photoconductors 40 are driven at different times. Alternatively, the photoconductors 40 may be driven at the same time.

When the phase shift amounts $Z_{YM}$ and $Z_{YC}$ are calculated and the reference position detection sensor 71Y detects the detection target 71*a* located at the rotation reference position, in step S22, the controller 500 accelerates or decelerates the photoconductors 40M and 40C, thus performing the phasing control. The controller 500 accelerates or decelerates the photoconductors 40M and 40C, in other words, the controller 500 increases or decreases the rotational speeds of the photoconductors 40M and 40C, to match the phases of the periodic fluctuations in image density of yellow, magenta, and cyan during two rotations of the photoconductors 40. In the example illustrated in FIG. 8, the controller 500 decreases the rotational speed of the photoconductor 40M and increases the rotational speed of the photoconductor 40C to match the phases of the periodic fluctuations in image density of yellow, magenta, and cyan.

When yellow, magenta, and cyan have identical phases of the periodic fluctuations in image density, the relative positions in the direction of rotation A of the detection targets 71*a* located at the respective rotation reference positions of the photoconductors 40 indicate the target phase differences $\theta_{YM}$ and $\theta_{YC}$ as illustrated in FIG. 9B.

In the present example, the phases of periodic fluctuations in image density are matched with reference to yellow. Alternatively, the phasing control of periodic fluctuations in image density may be performed with reference to a color that is controlled at a smallest amount. For example, when yellow is used as a reference, the phase shift amount of magenta is relatively large. In other words, the difference between the rotational speeds of the photoconductors 40M and 40Y is relatively large. Such a relatively large difference in the rotational speed increases the time taken for the rotational speed of the photoconductor 40M to reach the rotational speed for image formation after the phasing control. As a result, the phase of the periodic fluctuation in image density of magenta may deviate from those of yellow and cyan. An increased period of time taken for the phasing control allows the controller 500 to match the phases of the periodic fluctuations in image density with a relatively small difference in the rotational speed. On the other hand, such an increased period of time taken for the phasing control may delay the time at which printing starts.

In order to prevent such a delay, the controller 500 preferably matches the phases of periodic fluctuations in image density with, as a reference color, a color having a smallest phase shift amount calculated. Specifically, first, the controller 500 calculates a phase shift amount $Z_{MC}$ between cyan and magenta, in addition to the phase shift amounts $Z_{YM}$ and $Z_{YC}$. Next, the controller 500 sets, as a reference color, a color included in both of the two phase shift amounts excluding the largest phase shift amount of the calculated three phase shift amounts. The controller 500 increases or decreases the rotational speed of the photoconductors 40 for the colors other than the reference color to match the phases of periodic fluctuations in image density.

In the present example, relative to the rotational speed of the photoconductor 40 for the reference color, the controller 500 increases or decreases the rotational speed of the photoconductors 40 for the colors other than the reference color for a specific period of time to match the phases of periodic fluctuations in image density of yellow, magenta, and cyan. Alternatively, based on the calculated phase shift amounts, the controller 500 may control the photoconductor drive motors 72 to rotate the photoconductors 40 for the colors other than the reference color at a time different from the time when the photoconductor 40 for the reference color is rotated, to match the phases of the periodic fluctuations in image density of yellow, magenta, and cyan.

Figure 10A:
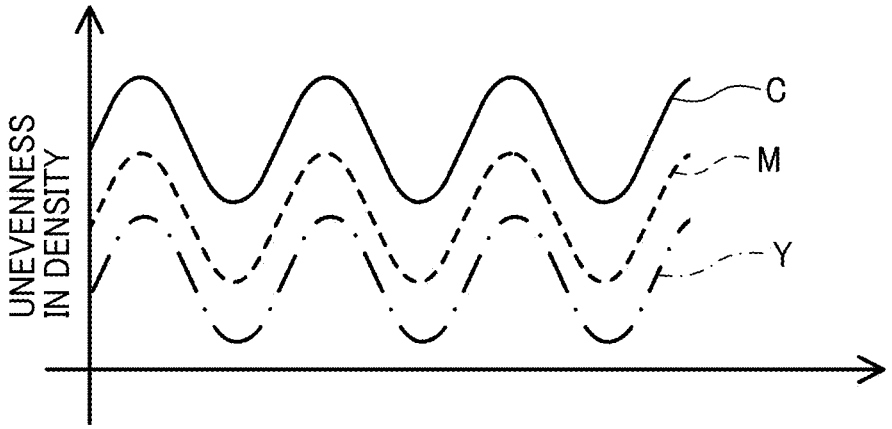
FIG. 10A is a graph illustrating periodic fluctuations in image density of yellow, magenta, and cyan after the phasing control of periodic fluctuations in image density is performed.
Figure 10B:
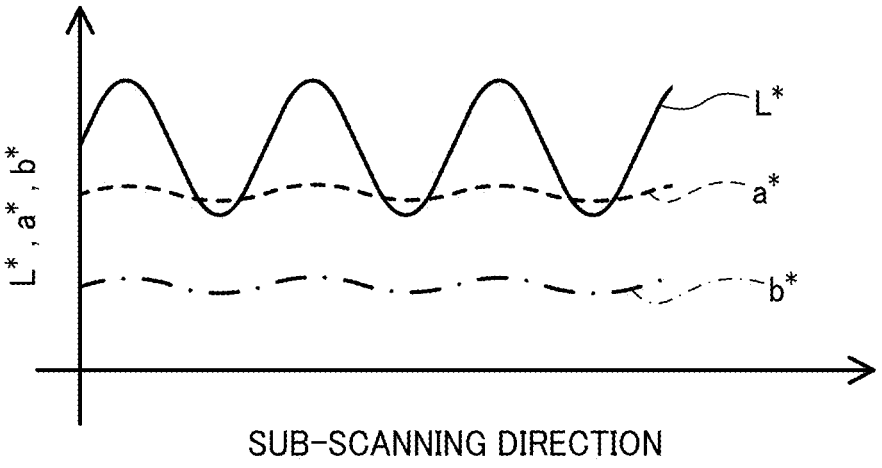
FIG. 10B is a graph illustrating the lightness L* and chromaticities a* and b* in the sub-scanning direction of a 3C gray image formed by superimposing yellow, magenta, and cyan images one atop another, with phases of the periodic fluctuations in image density matched.

FIG. 10A is a graph illustrating periodic fluctuations in image density of yellow, magenta, and cyan after the phasing control of periodic fluctuations in image density is performed. FIG. 10B is a graph illustrating the lightness L* and chromaticities a* and b* in the sub-scanning direction of a 3C gray image formed by superimposing yellow, magenta, and cyan images one atop another, with the phases of the periodic fluctuations in image density matched.

As illustrated in FIGS. 10A and 10B, matching the phases of the periodic fluctuations in image density of yellow, magenta, and cyan reduces the fluctuations of the chromaticities a* and b* in the sub-scanning direction of the 3C gray image formed by superimposing yellow, magenta, and cyan images one atop another.

When the density is high, the chromaticity a* fluctuates in the positive direction for magenta; whereas the chromaticity a* fluctuates in the negative direction for yellow and cyan. When the density is high, the chromaticity b* fluctuates in the positive direction for yellow; whereas the chromaticity b* fluctuates in the negative direction for magenta and cyan.

As described above, by performing the phasing control of periodic fluctuations in image density to match the phases of the periodic fluctuations in image density of yellow, magenta, and cyan and performing the printing operation, the variation in tint of a color image portion formed by superimposing yellow, magenta, and cyan one atop another as appropriate is reduced. Accordingly, a good image is acquired.

Figure 11:
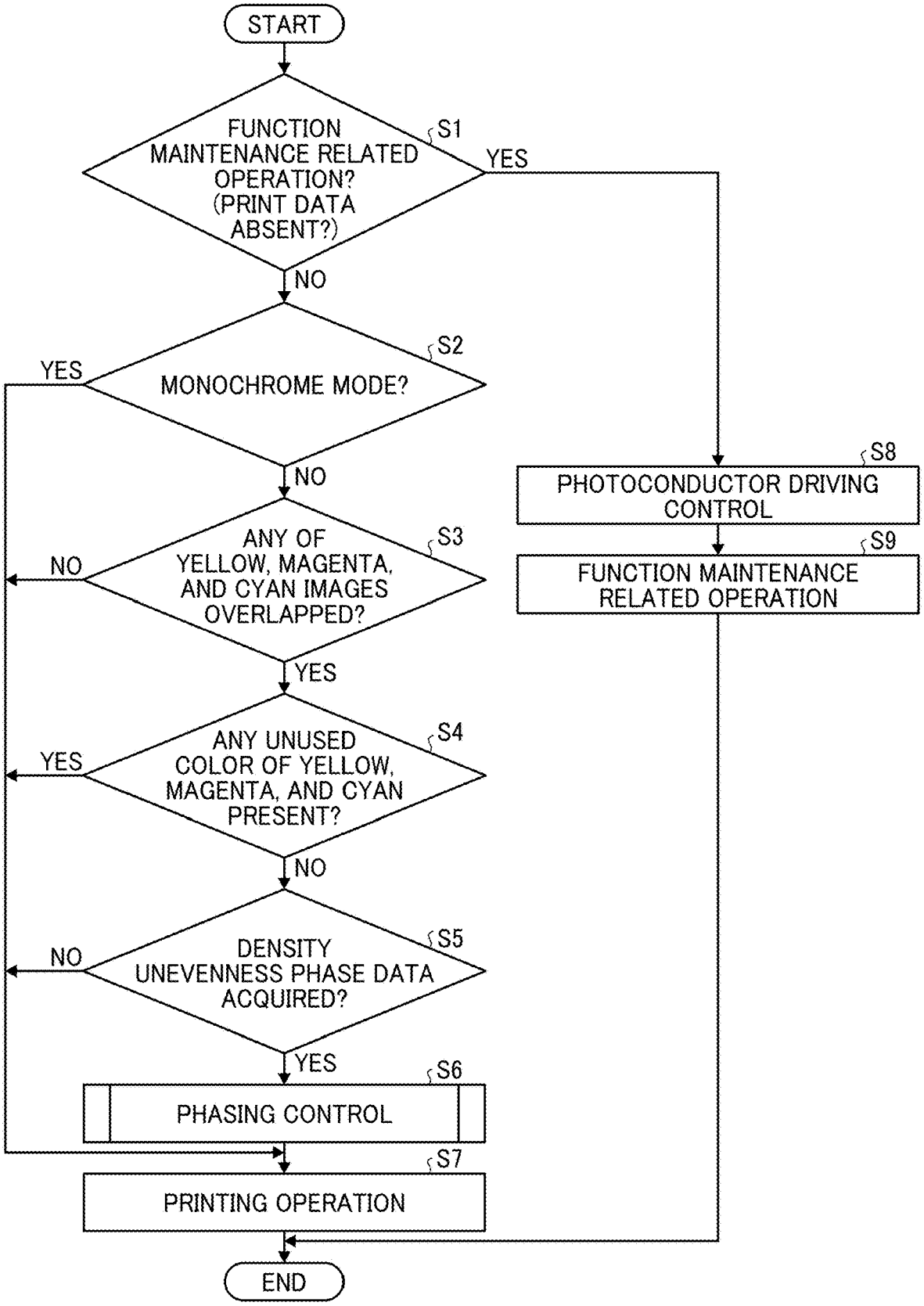
FIG. 11 is a flowchart of a process for determining whether to perform phasing control of periodic fluctuations in image density.

Referring now to FIG. 11, a description is given of determination as to whether to perform the phasing control of periodic fluctuations in image density.

FIG. 11 is a flowchart of a process for determining whether to perform the phasing control of periodic fluctuations in image density.

The controller 500 determines whether to perform the phasing control of periodic fluctuations in image density when driving the photoconductors 40.

In step S1, the controller 500 determines whether an operation of driving the photoconductor 40 is a "function maintenance related operation," which is an operation related to maintenance of functions of the image forming apparatus 1. The function maintenance related operation includes a function maintaining operation of maintaining the functions of the image forming apparatus 1 and a function maintenance confirming operation of confirming that the functions of the image forming apparatus 1 are maintained. In the present embodiment, when print data is absent, the controller 500 determines that the operation of driving the photoconductor 40 is the function maintenance related operation. Examples of the function maintenance related operation of driving the photoconductor 40 include, but are not limited to, an image adjusting operation, a belt-width-direction positioning operation, a belt-speed detection sensor adjusting operation, a startup checking operation, a reverse rotating operation, and an inching operation.

Now, a description is given of the image adjusting operation.

In the image adjusting operation, for example, a test pattern such as a gradation pattern or an alignment pattern is formed on the intermediate transfer belt 10 and detected by the toner adhesion amount sensor 310 to determine whether an image forming function is maintained. When determining, based on a result of detection performed by the toner adhesion amount sensor 310 on the test pattern, that the image density is not a target density and the image forming function is not maintained, the controller 500 adjusts the charging bias, the developing bias, and the exposure power to acquire the target image density.

When the toner images of yellow, magenta, cyan, and black formed on the intermediate transfer belt 10 are misaligned, the controller 500 adjusts the time at which the exposure starts.

With such adjustment, the image forming function is maintained. The image adjusting operation is a function maintaining operation of maintaining the image forming function. Specifically, in the image adjusting operation, the controller 500 adjusts the image density for each color to be a target image density or eliminates the misalignment between the toner images of yellow, magenta, cyan, and black, for example. The image adjusting operation is not affected even without the phasing control. Specifically, the misalignment adjustment or the image density adjustment based on the result of detection of the test pattern is not affected even when the fluctuations of the chromaticities a* and b* of a composite image of yellow, magenta, and cyan are not reduced. Note that the composite image of yellow, magenta, and cyan is formed by superimposing yellow, magenta, and cyan images one atop another. For the reason described above, when the controller 500 determines that the operation of driving the photoconductor 40 is the function maintenance related operation and the function maintenance related operation is the image adjusting operation (YES in step S1), the phasing control is not performed before the image adjusting operation. Instead, in steps S8 and S9, the controller 500 performs photoconductor speed control (or photoconductor driving control) and the image adjusting operation, respectively. Thus, an execution time of the image adjusting operation is shortened, as compared with a case where the image adjusting operation is performed after the phasing control. Note that the execution time is a period of time from when the start of an operation (in this case, the image adjusting operation) is instructed to when the operation is completed.

Now, a description is given of the startup checking operation.

The startup checking operation is the function maintenance continuing operation of confirming that the functions of image forming apparatus 1 are maintained. Specifically, in the startup checking operation, the controller 500 confirms that each of the photoconductors 40 is properly driven when the power is turned on or when the image forming apparatus 1 returns from a standby state. The startup checking operation is performed to confirm at least that each of the photoconductors 40 is properly driven. In other words, when the function maintenance related operation is the startup checking operation, the phasing control is not to be performed before the startup checking operation. In other words, the fluctuations of the chromaticities a* and b* of the composite image of yellow, magenta, and cyan are not to be reduced before the startup checking operation. For this reason, when the controller 500 determines that the operation of driving the photoconductor 40 is the function maintenance related operation and the function maintenance related operation is the startup checking operation (YES in step S1), in steps S8 and S9, the controller 500 performs the photoconductor speed control and the startup checking operation, respectively, without performing the phasing control. Thus, the execution time of the startup checking operation is shortened, as compared with a case where the startup checking operation is performed after the phasing control.

Now, a description is given of the reverse rotating operation.

The reverse rotating operation is a function maintaining operation of maintaining the functions of the photoconductor cleaners 63. Specifically, in the reverse rotating operation, the controller 500 rotates the photoconductor 40 in a direction opposite the direction of rotation A, which is a direction of rotation during the printing operation, for a certain period of time to remove deposits such as toner deposited on a contact portion of a cleaning member of the photoconductor cleaner 63 in contact with the photoconductor 40. Similar to the case where the function maintenance related operation is the startup checking operation, when the function maintenance related operation is the reverse rotating operation, the phasing control is not to be performed before the reverse rotating operation. In other words, the fluctuations of the chromaticities a* and b* of the composite image of yellow, magenta, and cyan are not to be reduced before the reverse rotating operation. For this reason, when the controller 500 determines that the operation of driving the photoconductor 40 is the function maintenance related operation and the function maintenance related operation is the reverse rotating operation (YES in step S1), in steps S8 and S9, the controller 500 performs the photoconductor speed control and performs the reverse rotating operation, respectively, without performing the phasing control. Thus, the execution time of the reverse rotating operation is shortened, as compared with a case where the reverse rotating operation is performed after the phasing control.

Now, a description is given of the inching operation.

The inching operation is a function maintaining operation of maintaining the functions of the photoconductors 40. For example, at a portion of the photoconductor 40 facing the charger 60, discharge products may accumulate to cause a decrease in sensitivity, resulting in the unevenness in sensitivity in the sub-scanning direction. To address such a situation, the inching operation is performed at a given time after the end of the printing operation. Specifically, in the inching operation, the controller 500 slightly rotates each of the photoconductors 40 to shift a stopping position at which each of the photoconductors 40 stops. Shifting the stopping position as described above prevents the discharge products from accumulating on one place, thus preventing the unevenness in sensitivity of the photoconductors 40. Accordingly, the functions of the photoconductors 40 are maintained. Such an inching operation may not require the phasing control. In other words, the fluctuations of the chromaticities a* and b* of the composite image of yellow, magenta, and cyan are not to be reduced before the inching operation.

For this reason, when the controller 500 determines that the operation of driving the photoconductor 40 is the function maintenance related operation and the function maintenance related operation is the inching operation (YES in step S1), in steps S8 and S9, the controller 500 performs the photoconductor speed control and the inching operation, respectively, without performing the phasing control. Thus, the execution time of the inching operation is shortened, as compared with a case where the inching operation is performed after the phasing control.

Now, a description is given of the belt-width-direction positioning operation.

The image forming apparatus 1 includes a belt skewing control assembly 11 to swing a stretching roller that stretches the intermediate transfer belt 10 to correct skewing of the intermediate transfer belt 10. The image forming apparatus 1 including the belt skewing control assembly 11 performs the belt-width-direction positioning operation when the intermediate transfer belt 10 is replaced or when a skewing detection sensor detects the skewing of the intermediate transfer belt 10. The belt-width-direction positioning operation is a function maintaining operation of maintaining the functions of the intermediate transfer belt 10. Specifically, in the belt-width-direction positioning operation, the controller 500 restrains the skewing of the intermediate transfer belt 10 in the width direction thereof within a certain range. Note that the belt skewing control assembly 11 may employ a configuration and a way of controlling the movement of the intermediate transfer belt 10 in the width direction thereof described in, for example, Japanese Unexamined Patent Application Publication No. 2008-275800 incorporated by reference herein.

The performance of the belt skewing control assembly 11 to control the displacement of the intermediate transfer belt 10 in the width direction thereof changes depending on whether the photoconductor 40 is in contact with the intermediate transfer belt 10. For this reason, the controller 500 drives, for a specific period of time, the intermediate transfer belt 10 and the photoconductors 40 in contact with each other to perform the belt-width-direction positioning operation. As described above, the belt-width-direction positioning operation is a function maintenance related operation performed by driving the photoconductors 40. In the belt-width-direction positioning operation, the skewing of the intermediate transfer belt 10 is reliably corrected even without the phasing control, in other words, even when the fluctuations of the chromaticities a* and b* of the composite image of yellow, magenta, and cyan are not reduced. For this reason, when the controller 500 determines that the operation of driving the photoconductor 40 is the function maintenance related operation and the function maintenance related operation is the belt-width-direction positioning operation (YES in step S1), in steps S8 and S9, the controller 500 performs the photoconductor speed control and the belt-width-direction positioning operation, respectively, without performing the phasing control. Thus, the execution time of the belt-width-direction positioning operation is shortened, as compared with a case where the belt-width-direction positioning operation is performed after the phasing control.

Now, a description is given of the belt-speed detection sensor adjusting operation.

The image forming apparatus 1 includes a rotational speed detection sensor 12 serving as a rotational speed detector that detects the rotational speed of the intermediate transfer belt 10, like a rotational speed detection sensor described in, for example, Japanese Unexamined Patent Application Publication No. 2017-083311 incorporated by reference herein. The rotational speed of the intermediate transfer belt 10 detected by the rotational speed detection sensor 12 is fed back to belt driving control. The rotational speed detection sensor 12 is a reflective optical sensor that detects a plurality of marks disposed on a belt scale at regular intervals along the belt moving direction. The rotational speed of the intermediate transfer belt 10 is detected based on a result of detection of the marks, which are detected by the reflective optical sensor.

The image forming apparatus 1 including the rotational speed detection sensor 12 performs the belt-speed detection sensor adjusting operation at the time of replacement of the intermediate transfer belt 10 or at a given time to adjust an amount of light emitted by the rotational speed detection sensor 12 and detect an amount of expansion or contraction of the intermediate transfer belt 10. The controller 500 corrects the detected intervals of the marks based on the detected amount of expansion or contraction of the intermediate transfer belt 10 to maintain the function of accurately detecting the rotational speed of the intermediate transfer belt 10. In short, the controller 500 controls the rotational speed of the intermediate transfer belt 10 with accuracy.

In order to accurately detect the amount of expansion or contraction of the intermediate transfer belt 10 by the belt-speed detection sensor adjusting operation as a function maintaining operation, the photoconductor 40 and the intermediate transfer belt 10 are to be driven while the photoconductor 40 and the intermediate transfer belt 10 are in contact with each other. The belt-speed detection sensor adjusting operation is not affected even without the phasing control. Specifically, a result of adjustment of the amount of light emitted and a result of detection of the amount of expansion or contraction of the intermediate transfer belt 10 is not affected even when the fluctuations of the chromaticities a* and b* of a composite image of yellow, magenta, and cyan are not reduced. For this reason, when the controller 500 determines that the operation of driving the photoconductor 40 is the function maintenance related operation and the function maintenance related operation is the belt-speed detection sensor adjusting operation (YES in step S1), in steps S8 and S9, the controller 500 performs the photoconductor speed control and the belt-speed detection sensor adjusting operation, respectively, without performing the phasing control. Thus, the execution time of the belt-speed detection sensor adjusting operation is shortened, as compared with a case where the belt-speed detection sensor adjusting operation is performed after the phasing control.

On the other hand, when print data is present, the controller 500 determines that the operation of driving the photoconductor 40 is a printing operation, not a function maintenance related operation (NO in step S1). Note that the image forming apparatus 1 of the present embodiment determines, based on the presence or absence of print data, whether the operation of driving the photoconductor 40 is the function maintenance related operation. The image forming apparatus 1 also determines whether the operation of driving the photoconductor 40 is the image adjusting operation, the startup checking operation, the reverse rotating operation, the inching operation, the belt-width-direction positioning operation, or the belt-speed detection sensor adjusting operation. When the operation of driving the photoconductor 40 is not the image adjusting operation, the startup checking operation, the reverse rotating operation, the inching operation, the belt-width-direction positioning operation, or the belt-speed detection sensor adjusting operation, the controller 500 may determine that the operation of driving the photoconductor 40 is the printing operation.

When the print data is present and the operation of driving the photoconductor 40 is the printing operation, in step S2, the controller 500 determines whether a printing mode is a monochrome mode or a color mode. The controller 500 sets the printing mode based on the print data. Alternatively, a user may set the printing mode through a control panel or a personal computer in which a printer driver is installed.

When the printing mode is the monochrome mode (YES in step S2), the controller 500 drives the photoconductor 40K to form a black image alone. Since the black image is formed alone, yellow, magenta, and cyan images are not superimposed one atop another. In short, the chromaticities a* and b* do not fluctuate. For this reason, when the printing mode is the monochrome mode (YES in step S2), in step S7, the controller 500 performs the printing operation, without performing the phasing control. Accordingly, the printing time in the monochrome mode is shortened, as compared with a case where the printing operation is performed after the phasing control. In the monochrome mode of the present embodiment, the photoconductor 40K is rotated alone. Alternatively, the photoconductors 40Y, 40M, 40C, and 40K may be rotated.

By contrast, when the printing mode is the color mode (NO in step S2), in step S3, the controller 500 determines whether the yellow, magenta, and cyan images have a portion overlapping another color image, in other words, whether any of the yellow, magenta, and cyan images are overlapped.

When the print data does not include green (overlapped yellow and cyan), blue (overlapped magenta and cyan), or red (overlapped magenta and yellow), the controller 500 determines that none of the yellow, magenta, and cyan images has a portion overlapping another color image, in other words, none of the yellow, magenta, and cyan images are overlapped. When a single color of yellow, magenta, and cyan is used, none of the yellow, magenta, and cyan images has a portion overlapping another color image. Therefore, also in this case, the controller 500 determines that none of the yellow, magenta, and cyan images has a portion overlapping another color image, in other words, none of the yellow, magenta, and cyan images are overlapped.

As described above, the phase shift in the unevenness in image density indicates the fluctuations of the chromaticities a* and b* of the yellow, magenta, and cyan images superimposed one atop another. In other words, when none of the yellow, magenta, and cyan images have a portion overlapping another color image, the hue of the printed image does not vary in the sub-scanning direction even when the phases of the unevenness in image density of yellow, magenta, and cyan are not matched.

For this reason, when none of the yellow, magenta, and cyan images has a portion overlapping another color image, in other words, when none of the yellow, magenta, and cyan images are overlapped (NO in step S3), in step S7, the controller 500 performs the printing operation, without performing the phasing control. Accordingly, the printing time is shortened, as compared with the case where the printing operation is performed after the phasing control. In addition, a good image without a change in hue is acquired.

By contrast, when the yellow, magenta, and cyan images have a portion overlapping another color image, in other words, when any of the yellow, magenta, and cyan images are overlapped (YES in step S3), in step S4, the controller 500 determines whether any unused color of yellow, magenta, and cyan is present. When two colors of yellow, magenta, and cyan are used, the variation in hue of the printed image is less noticeable than when all colors of yellow, magenta, and cyan are used.

For this reason, when any unused color of yellow, magenta, and cyan is present (YES in step S4), in step S7, the controller 500 performs the printing operation, without performing the phasing control. Accordingly, the printing time is shortened, as compared with the case where the printing operation is performed after the phasing control.

When two colors of yellow, magenta, and cyan are used, the hue varies in the sub-scanning direction at an overlapped portion of the two colors. For this reason, for example, in a case where a user selects an image quality priority mode from the image quality priority mode and a speed priority mode, the controller 500 does not perform the determination of step S4. By contrast, in a case where the user selects the speed priority mode, the controller 500 may perform the determination of step S4 and perform the printing operation without performing the phasing control when two of yellow, magenta, and cyan are used.

When any unused color of yellow, magenta, and cyan is present, the controller 500 may separate the photoconductor 40 for the color of which an image is not formed from the intermediate transfer belt 10 and stop the driving of the photoconductor 40.

When all colors of yellow, magenta, and cyan are used (NO in step S4), in step S5, the controller 500 determines whether density unevenness phase data has been acquired. When the density unevenness phase data has not been acquired (NO in step S5), the phasing control cannot be performed. In step S7, the controller 500 performs the printing operation, without performing the phasing control. By contrast, when the density unevenness phase data has been acquired (YES in step S5), in step S6, the controller 500 performs the phasing control. Then, in step S7, the controller 500 performs the printing operation.

As described above, the density unevenness phase data is acquired by the control for acquiring periodic fluctuations in image density, which is performed immediately after the photoconductors 40 are set, for example. The density unevenness phase data is not acquired when a print command is input during execution of the control for acquiring periodic fluctuations in image density immediately after the photoconductors 40 are set. In the present embodiment, when the print command is input during execution of the control for acquiring periodic fluctuations in image density, the controller 500 stops the control for acquiring periodic fluctuations in image density and performs the printing operation. At this time, since the density unevenness phase data is not acquired, the controller 500 performs the printing operation without performing the phasing control. When the controller 500 performs the printing operation without performing the phasing control, the chromaticities a* and b* of overlapped portions of the yellow, magenta, and cyan images greatly fluctuate, resulting in formation of an image with poor quality. For this reason, when the print command is input during execution of the control for acquiring periodic fluctuations in image density, the following is displayed on the control panel or a screen of the personal computer in which the printer driver is installed. Specifically, a warning image is displayed for a user to determine whether to print an image with poor quality or print an image after the control for acquiring periodic fluctuations in image density. When the user selects to print the image with poor quality based on the warning image, the controller 500 stops the control for acquiring periodic fluctuations in image density and performs the printing operation. By contrast, when the user selects to print the image after the control for acquiring periodic fluctuations in image density, the controller 500 performs the phasing control after the control for acquiring periodic fluctuations in image density to perform the printing operation.

As described above, with respect to an operation that is accompanied by rotation of the photoconductors 40 and that does not require the phasing control in the present embodiment, the controller 500 starts the operation without performing the phasing control. In short, the image forming apparatus 1 of the present embodiment shortens the execution time of the operation.

In the case of a function maintenance related operation that enhances the checking accuracy and the maintenance accuracy when performed after the phasing control, the controller 500 preferably performs the function maintenance related operation after performing the phasing control.

Figure 12:
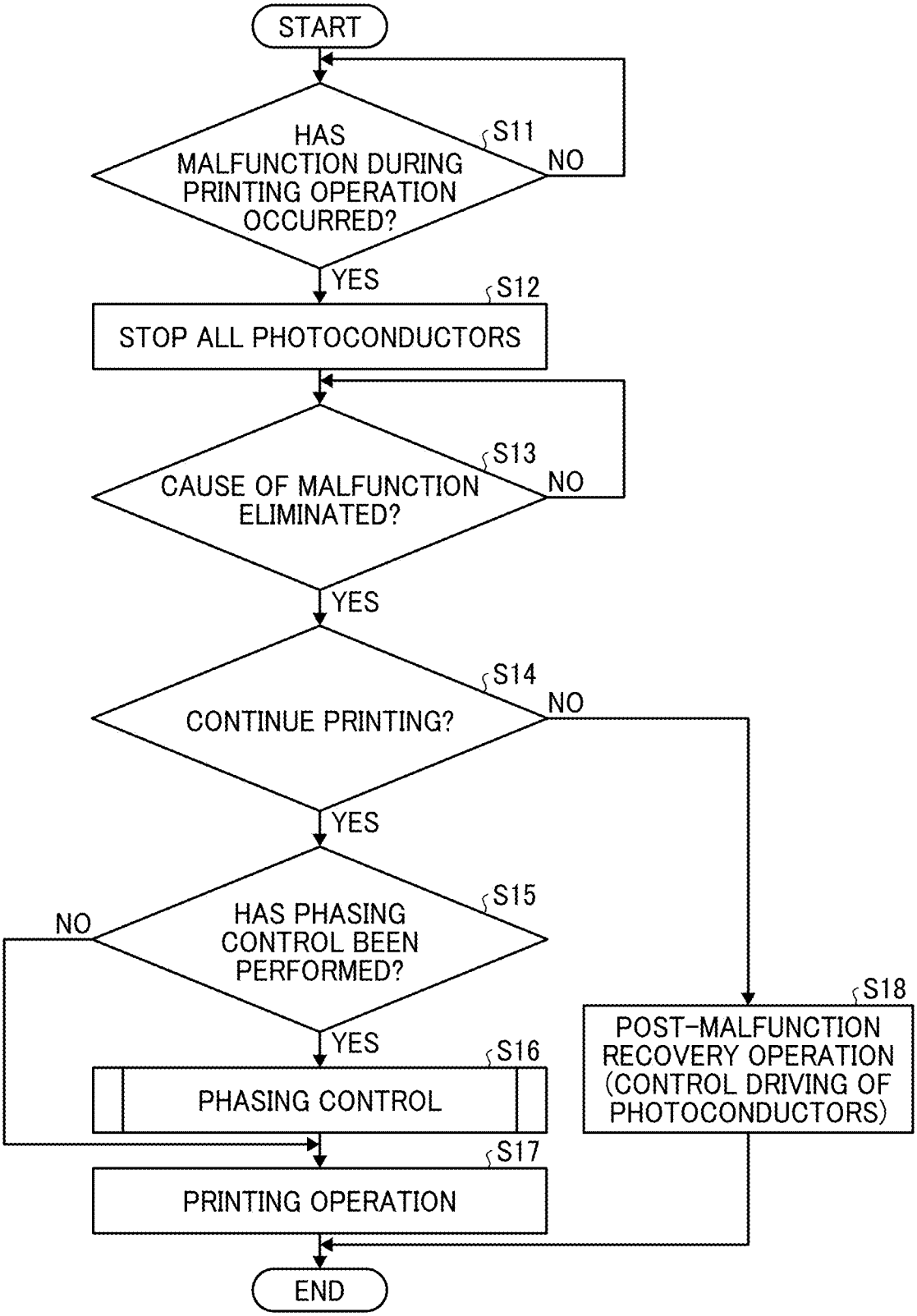
FIG. 12 is a flowchart of a control process performed in response to malfunction during a printing operation.

FIG. 12 is a flowchart of a control process performed in response to malfunction during a printing operation.

In step S11, the controller 500 determines whether malfunction such as abnormal load or a paper jam has occurred during a printing operation. When the malfunction has not occurred (NO in step S11), the determination of step S11 is repeated. By contrast, when the malfunction has occurred (YES in step S11), in step S12, the controller 500 stops driving all the photoconductors 40. In step S13, the controller 500 determines whether the cause of the malfunction is eliminated by a user. When the cause of the malfunction is not eliminated (NO in step S13), the determination of step S13 is repeated. When the cause of the malfunction is eliminated (YES in step S13), in step S14, the controller 500 displays, on the control panel, an image for the user to determine whether to continue the printing operation (i.e., printing). When the user selects to continue the printing operation based on the image (YES in step S14), in step S15, the controller 500 determines whether the phasing control has been performed before the current printing operation.

When the phasing control has been performed, the current printing operation is a printing operation that is determined in the flow illustrated in FIG. 11 to require the phasing control before the printing operation. If the controller 500 performs the printing operation without performing the phasing control, the image forming apparatus 1 may output a poor-quality image having a large variation in the chromaticities a* and b*. To prevent such a situation, when the phasing control has been performed (YES in step S15), in step S16, the controller 500 performs the phasing control to match the phases of the unevenness in image density of yellow, magenta, and cyan. In step S17, the controller 500 resumes the printing operation.

By contrast, when the phasing control has not been performed, the current printing operation does not require the phasing control because the print image is a monochrome image or none of the yellow, magenta, and cyan images has a portion overlapping another color image. In short, when the phasing control has not been performed (NO in step S15), in step S17, the controller 500 resumes the printing operation, without performing the phasing control. In this case, the printing operation is resumed earlier than a case where the printing operation is resumed after the phasing control is performed.

On the other hand, when the user selects to stop the printing operation based on the image (NO in step S14), in step S18, the controller 500 performs a post-malfunction recovery operation as a function confirming operation of driving, e.g., the photoconductors 40 to confirm that each component properly operates. Since the post-malfunction recovery operation is performed to confirm at least that each component properly operates, the phasing control is not to be performed before the post-malfunction recovery operation. In other words, the fluctuations of the chromaticities a* and b* of the composite image of yellow, magenta, and cyan are not to be reduced before the post-malfunction recovery operation. For this reason, when driving the photoconductors 40 in the post-malfunction recovery operation, the controller 500 performs the post-malfunction recovery operation without performing the phasing control. In this case, the execution time of the post-malfunction recovery operation is shortened, as compared with a case where the phasing control is performed before the post-malfunction recovery operation.

Although the image forming apparatus 1 of the present embodiment includes the image forming units 18Y, 18M, 18C, and 18K that respectively form toner images of four colors, namely, yellow, magenta, cyan, and black, the image forming apparatus of another embodiment may form toner images of five colors including a spot color. For example, toner of neon pink may be used as the spot color toner. The toner of neon pink and the toners of yellow, magenta, and cyan superimposed one atop another enhances the expression of a skin color or an orange color. If the phase of the unevenness in density of a neon pink image is different from the phase of the unevenness in density of each of yellow, magenta, and cyan images, a composite toner image formed by superimposing neon pink image and the yellow, magenta, and cyan images one atop another may have a variation in tint. As a result, the image quality may deteriorate. To prevent such a situation, the controller 500 acquires the phase of periodic fluctuation in image density for neon pink. In a case where the neon pink image and the yellow, magenta, and cyan images are superimposed one atop another, the controller 500 performs the printing operation after performing the phasing control for the unevenness in densities of the neon pink image and the yellow, magenta, and cyan images. Since the variation in tint is reduced at an overlapped portion of the neon pink image and the yellow, magenta, and cyan images, a full-color image with high quality is acquired.

The image forming apparatus 1 of the present embodiment determines whether to perform the phasing control for each of the image adjusting operation, the startup checking operation, the reverse rotating operation, the inching operation, the belt-width-direction positioning operation, the belt-speed detection sensor adjusting operation, and the post-malfunction recovery operation as the function maintenance related operations. Alternatively, the image forming apparatus 1 may determine whether to perform the phasing control for at least one of the image adjusting operation, the startup checking operation, the reverse rotating operation, the inching operation, the belt-width-direction positioning operation, the belt-speed detection sensor adjusting operation, and the post-malfunction recovery operation.

The image forming apparatus 1 may determine whether to perform the phasing control based on at least one of whether the printing mode is the monochrome mode, whether the yellow, magenta, and cyan images have a portion overlapping another color image, whether any unused color of yellow, magenta, and cyan is present, and whether the density unevenness phase data has been acquired.

Although specific embodiments are described, the embodiments according to the present disclosure are not limited to those specifically described herein. Several aspects of the image forming apparatus are exemplified as follows.

Now, a description is given of a first aspect.

An image forming apparatus (e.g., the image forming apparatus 1) includes a plurality of image bearers (e.g., the photoconductors 40), a plurality of rotation reference position detectors (e.g., the reference position detection sensors 71) each facing a corresponding image bearer of the plurality of image bearers to detect a rotation reference position of the corresponding image bearer, and circuitry (e.g., the controller 500) to perform, before an operation of rotating the plurality of image bearers, alignment control such as phasing control based on a result of detection performed by the plurality of rotation reference position detectors. The alignment control is control of driving of the plurality of image bearers to acquire a given relationship between the respective rotation reference positions of the plurality of image bearers. The circuitry determines whether to perform the alignment control based on whether the operation of rotating the plurality of image bearers is a function maintenance related operation.

As described above, examples of the operation of rotating the plurality of image bearers include, but are not limited to, the image forming operation and the function maintenance related operation that is related to maintenance of functions of the image forming apparatus. The function maintenance related operation is not affected even when the alignment control is not performed before the function maintenance related operation.

A typical image forming apparatus may allow a user to determine and set whether to perform the alignment control before the image forming operation as an operation of rotating the plurality of image bearers. When a CPU of the typical image forming apparatus determines that the current printing mode is a monochrome mode, the typical image forming apparatus may execute the image forming operation, without performing the alignment control. However, the typical image forming apparatus may perform or may not perform the alignment control before the function maintenance related operation. If the typical image forming apparatus performs the alignment control before the function maintenance related operation, the typical image forming apparatus takes a longer execution time of the function maintenance related operation, compared with the image forming apparatus of the embodiments described above. As described above, the execution time of the function maintenance related operation is a period of time from when the start of the function maintenance related operation is instructed to when the function maintenance related operation is completed.

According to the first aspect, the circuitry determines whether to perform the alignment control based on whether the operation of rotating the plurality of image bearers is the function maintenance related operation. When the operation of rotating the plurality of image bearers is the function maintenance related operation, the image forming apparatus does not perform the alignment control. Accordingly, when the start of the function maintenance related operation is instructed, the image forming apparatus starts the function maintenance related operation, without performing the alignment control before the function maintenance related operation, thus shortening the execution time of the function maintenance related operation.

Now, a description is given of a second aspect.

In the image forming apparatus of the first aspect, the circuitry (e.g., the controller 500) does not perform the alignment control (e.g., the phasing control) in a case where the operation of rotating the plurality of image bearers (e.g., the photoconductors 40) is the function maintenance related operation.

According to the present aspect, as described in the embodiments, the execution time of the function maintenance related operation is shortened.

Now, a description is given of a third aspect.

In the image forming apparatus of the first or second aspect, the operation of rotating the plurality of image bearers (e.g., the photoconductors 40) includes an image forming operation such as a printing operation. The circuitry (e.g., the controller 500) determines whether to perform the alignment control based on an image forming mode such as a printing mode or image data such as print data.

As described in the embodiments, in some cases such as a case where a monochrome image is formed and a case where the yellow, magenta, and cyan images have no overlapped portions, an image that is formed is not affected even when the alignment control such as the phasing control is not performed before the image forming operation such as the printing operation. According to the present aspect, the image forming apparatus determines whether to perform the alignment control before the image forming operation based on the image forming mode such as the printing mode or the information of the image data such as the print data, thus shortening the image forming operation that does not require the alignment control such as the image forming operation of the monochrome image.

Now, a description is given of a fourth aspect.

In the image forming apparatus of the third aspect, the circuitry (e.g., the controller 500) does not perform the alignment control (e.g., the phasing control) in a case where the image forming mode (e.g., the printing mode) is a monochrome mode or the image data (e.g., the print data) is monochrome.

As described in the embodiments, a monochrome image that is formed does not have a variation in tint. In other words, the quality of the image does not deteriorate even when the alignment control such as the phasing control is not performed. According to the present aspect, the image forming apparatus does not perform the alignment control before the image forming operation such as the printing operation in a case where the image forming mode is the monochrome mode or the image data is monochrome, thus shortening the time taken to print the monochrome image or the printing time in the monochrome mode.

Now, a description is given of a fifth aspect.

In the image forming apparatus of the third or fourth aspect, the circuitry (e.g., the controller 500) determines, in response to images being transferred from the plurality of image bearers onto a recording medium, whether the images are superimposed one atop another, based on the image data (e.g., the print data). The circuitry does not perform the alignment control (e.g., the phasing control) in a case where the images are not superimposed one atop another.

As described in the embodiments, the images that are not superimposed one atop another have no variation in tint. In other words, the quality of the images does not deteriorate even when the alignment control such as the phasing control is not performed. According to the present aspect, in a case where the images are not superimposed one atop another, the image forming apparatus does not perform the alignment control before the image forming operation such as the printing operation, thus shortening the printing time.

Now, a description is given of a sixth aspect.

In the image forming apparatus of any one of the third to fifth aspects, the circuitry (e.g., the controller 500) determines, based on the image data (e.g., the print data), whether no image is formed on at least one of the plurality of image bearers (e.g., the photoconductors 40). The circuitry does not perform the alignment control (e.g., the phasing control) in a case where no image is formed on at least one of the plurality of image bearers.

As described in the embodiments, the variation in tint of the image formed with some of the plurality of image bearers is reduced, compared with a full-color image formed with all of the plurality of image bearers on a recording medium. According to the present aspect, in a case where no image is formed on at least one of the plurality of image bearers, the image forming apparatus does not perform the alignment control before the image forming operation such as the printing operation, thus reducing the variation in tint and shortening the printing time.

Now, a description is given of a seventh aspect.

In the image forming apparatus of the sixth aspect, the circuitry (e.g., the controller 500) does not perform the alignment control (e.g., the phasing control) in a case where no image is formed on at least two of the plurality of image bearers (e.g., the photoconductors 40).

As described in the embodiments, the variation in tint of the image formed with some of the plurality of image bearers is reduced, compared with a full-color image formed with all of the plurality of image bearers on a recording medium. According to the present aspect, when no image is formed on at least two of the plurality of image bearers, the image forming apparatus does not perform the alignment control before the image forming operation such as the printing operation, thus reducing the variation in tint and shortening the printing time.

Now, a description is given of an eighth aspect.

In the image forming apparatus of any one of the first to seventh aspects, the circuitry (e.g., the controller 500) determines that the operation of rotating the plurality of image bearers (e.g., the photoconductors 40) is the function maintenance related operation in a case where no image data (e.g., print data) exists for the operation of rotating the plurality of image bearers.

Since no image data such as print data is transmitted from the scanner 300 or a personal computer for the function maintenance related operation, no image data exists. According to the present aspect, the circuitry determines, based on whether the image data is present or absent, whether the operation of rotating the plurality of image bearers such as the photoconductors 40 is the image forming operation such as the printing operation or the function maintenance related operation.

Now, a description is given of a ninth aspect.

In the image forming apparatus of any one of the first to eighth aspects, the function maintenance related operation is an image adjusting operation of forming a test pattern, detecting the test pattern with a detector (e.g., the toner adhesion amount sensor 310), and adjusting an image based on a result of detection performed by the detector.

The image adjusting operation is not affected even when the alignment control such as the phasing control is not performed. According to the present aspect, when the function maintenance related operation is the image adjusting operation, the image forming apparatus does not perform the alignment control, thus shortening the time taken for the image adjusting operation.

Now, a description is given of a tenth aspect.

In the image forming apparatus of any one of the first to ninth aspects, the function maintenance related operation is a startup operation of checking whether the plurality of image bearers (e.g., the photoconductors 40) is properly driven in response to startup of the image forming apparatus (e.g., the image forming apparatus 1).

As described in the embodiments, not performing the alignment control such as the phasing control does not affect the checking whether the plurality of image bearers such as the photoconductors 40 is properly driven. According to the present aspect, when the function maintenance related operation is the startup operation, the image forming apparatus does not perform the alignment control, thus shortening the time taken for the startup operation.

Now, a description is given of an eleventh aspect.

In the image forming apparatus of any one of the first to tenth aspects, the function maintenance related operation is a recovery operation after malfunction.

As described in the embodiments, the recovery operation after malfunction is a function maintenance related operation of confirming that the components such as the image bearers (e.g., the photoconductor 40) are properly driven. Such confirmation is not affected even when the alignment control such as the phasing control is not performed. According to the present aspect, when the function maintenance related operation is the recovery operation after malfunction, the image forming apparatus does not perform the alignment control, thus shortening the time taken for the recovery operation after malfunction.

Now, a description is given of a twelfth aspect.

In the image forming apparatus of any one of the first to eleventh aspects, the function maintenance related operation is a reverse rotating operation of rotating the plurality of image bearers (e.g., the photoconductors 40) in a direction opposite a direction of rotation during an image forming operation of the plurality of image bearers.

As described in the embodiments, the reverse rotating operation is a function maintenance related operation of maintaining a cleaning function by removing deposits such as toner deposited between a plurality of cleaners such as the photoconductor cleaners 63 and the plurality of image bearers. Maintenance of the functions of the plurality of cleaners is not affected even when the alignment control such as the phasing control is not performed. According to the present aspect, when the function maintenance related operation is the reverse rotating operation, the image forming apparatus does not perform the alignment control, thus shortening the time taken for the reverse rotating operation.

Now, a description is given of a thirteenth aspect.

In the image forming apparatus of any one of the first to twelfth aspects, the function maintenance related operation is an inching operation of slightly rotating the plurality of image bearers (e.g., the photoconductors 40) during standby.

As described in the embodiments, the inching operation is a function maintenance related operation of preventing the unevenness in sensitivity of the plurality of image bearers such as the photoconductors 40 by slightly rotating the plurality of image bearers during standby to prevent accumulation of discharge products, which are produced when a plurality of chargers such as the chargers 60 charges the plurality of image bearers, for example, on one place. Not performing the alignment control such as the phasing control does not affect the maintenance of the function of preventing the unevenness in sensitivity of the plurality of image bearers such as the photoconductors 40. According to the present aspect, when the function maintenance related operation is the inching operation, the image forming apparatus does not perform the alignment control, thus shortening the time taken for the inching operation.

Now, a description is given of a fourteenth aspect.

The image forming apparatus according to any one of the first to thirteenth aspects further includes an image density detector (e.g., the toner adhesion amount sensor 310) to detect respective image densities of toner images formed on the plurality of image bearers (e.g., the photoconductors 40). The toner images include image patterns (e.g., the image patterns 320) formed while the plurality of rotation reference position detectors (e.g., the reference position detection sensors 71) detects the respective rotation reference positions of the plurality of image bearers. The circuitry (e.g., the controller 500), as a device that acquires periodic fluctuations in image density, acquires periodic fluctuations in image density based on a result of detection performed by the image density detector on the image patterns and time when the plurality of rotation reference position detectors detects the respective rotation reference positions of the plurality of image bearers. The circuitry sets the relationship between the respective rotation reference positions of the plurality of image bearers based on the acquired periodic fluctuations in image density of the plurality of image bearers.

According to the present aspect, as described in the embodiments, the image forming apparatus sets the relationship between the respective rotation reference positions of the plurality of image bearers based on the periodic fluctuations in image density of the plurality of image bearers acquired with the device that acquires periodic fluctuations in image density, to match the phases of the periodic fluctuations in image density of the plurality of image bearers. As a result, when visible images formed by image forming units (e.g., the image forming units 18) are superimposed one atop another, respective portions of the images having a relatively low image density overlap each other and respective portions of the images having a relatively high image density overlap each other. Accordingly, the variation in tint of the images is reduced to enhance the image quality.

Now, a description is given of a fifteenth aspect.

In the image forming apparatus of the fourteenth aspect, the operation of rotating the plurality of image bearers (e.g., the photoconductors 40) includes an image forming operation such as a printing operation. The circuitry performs the image forming operation without performing the alignment control in a case where the circuitry does not acquire the periodic fluctuations in image density of the plurality of image bearers.

According to the present aspect, as described in the embodiments, the image forming apparatus produces a printed matter earlier than a typical image forming apparatus that performs the image forming operation after acquiring the periodic fluctuations in image density of the plurality of image bearers and becoming ready for the alignment control.

Now, a description is given of a sixteenth aspect.

The image forming apparatus according to any one of the first to fifteenth aspects further includes an intermediate transfer belt (e.g., the intermediate transfer belt 10) to which images are transferred from the plurality of image bearers (e.g., the photoconductors 40) and a belt skewing control assembly (e.g., the belt skewing control assembly 11) to control skewing of the intermediate transfer belt. The belt skewing control assembly performs a belt skewing correction operation as the function maintenance related operation.

As described in the embodiments, the belt skewing correction operation is not affected even when the alignment control such as the phasing control is not performed before the belt skewing correction operation. According to the present aspect, when the function maintenance related operation is the belt skewing correction operation, the image forming apparatus does not perform the alignment control, thus shortening the time taken for the belt skewing correction operation.

Now, a description is given of a seventeenth aspect.

The image forming apparatus of any one of the first to sixteenth aspect further includes an intermediate transfer belt (e.g., the intermediate transfer belt 10) to which images are transferred from the plurality of image bearers (e.g., the photoconductors 40) and a rotational speed detector (e.g., the rotational speed detection sensor 12) to detect a rotational speed of the intermediate transfer belt. The function maintenance related operation is an adjusting operation of the rotational speed detector.

As described in the embodiments, the adjustment of the rotational speed detector such as the rotational speed detection sensor 12 is not affected even when the alignment control such as the phasing control is not performed. According to the present aspect, when the function maintenance related operation is the adjusting operation of the rotational speed detector, the image forming apparatus does not perform the alignment control, thus shortening the time taken for the adjusting operation of the rotational speed detector.

According to the embodiments of the present disclosure, the image forming apparatus shortens the execution time of the function maintenance related operation.

The above-described embodiments are illustrative and do not limit the present invention. Thus, numerous additional modifications and variations are possible in light of the above teachings. For example, elements and/or features of different illustrative embodiments may be combined with each other and/or substituted for each other within the scope of the present invention.

Any one of the above-described operations may be performed in various other ways, for example, in an order different from the one described above.

The functionality of the elements disclosed herein may be implemented using circuitry or processing circuitry which includes general purpose processors, special purpose processors, integrated circuits, application specific integrated circuits (ASICs), digital signal processors (DSPs), field programmable gate arrays (FPGAs), conventional circuitry and/or combinations thereof which are configured or programmed to perform the disclosed functionality. Processors are considered processing circuitry or circuitry as they include transistors and other circuitry therein. In the disclosure, the circuitry, units, or means are hardware that carry out or are programmed to perform the recited functionality. The hardware may be any hardware disclosed herein or otherwise known which is programmed or configured to carry out the recited functionality. When the hardware is a processor which may be considered a type of circuitry, the circuitry, means, or units are a combination of hardware and software, the software being used to configure the hardware and/or processor.

The invention claimed is:

1. An image forming apparatus comprising:

a plurality of image bearers;

a plurality of rotation reference position detectors each facing a corresponding image bearer of the plurality of image bearers to detect a rotation reference position of the corresponding image bearer; and circuitry configured to:

perform, before an operation of rotating the plurality of image bearers, alignment control based on a result of detection performed by the plurality of rotation reference position detectors, the alignment control being control of driving of the plurality of image bearers to acquire a given relationship between the respective rotation reference positions of the plurality of image bearers; and determine whether to perform the alignment control based on whether the operation of rotating the plurality of image bearers is a function maintenance related operation, wherein the operation of rotating the plurality of image bearers includes an image forming operation, wherein the circuitry is configured to determine whether to perform the alignment control based on an image forming mode or image data, wherein the circuitry is configured to determine, in response to images being transferred from the plurality of image bearers onto a recording medium, whether the images are superimposed one atop another, based on the image data, and wherein the circuitry is configured not to perform the alignment control in a case where the images are not superimposed one atop another.

2. The image forming apparatus according to claim 1, wherein the circuitry is configured not to perform the alignment control in a case where the operation of rotating the plurality of image bearers is the function maintenance related operation.

3. The image forming apparatus according to claim 1, wherein the circuitry is configured not to perform the alignment control in a case where the image forming mode is a monochrome mode or the image data is monochrome.

4. The image forming apparatus according to claim 1, wherein the circuitry is configured to determine, based on the image data, whether no image is formed on at least one of the plurality of image bearers, and wherein the circuitry is configured not to perform the alignment control in a case where no image is formed on at least one of the plurality of image bearers.

5. The image forming apparatus according to claim 4, wherein the circuitry is configured not to perform the alignment control in a case where no image is formed on at least two of the plurality of image bearers.

6. The image forming apparatus according to claim 1, wherein the circuitry is configured to determine that the operation of rotating the plurality of image bearers is the function maintenance related operation in a case where no image data exists for the operation of rotating the plurality of image bearers.

7. The image forming apparatus according to claim 1, wherein the function maintenance related operation is an image adjusting operation of forming a test pattern, detecting the test pattern with a detector, and adjusting an image based on a result of detection performed by the detector.

8. The image forming apparatus according to claim 1, wherein the function maintenance related operation is a startup operation of checking whether the plurality of image bearers is properly driven in response to startup of the image forming apparatus.

9. The image forming apparatus according to claim 1, wherein the function maintenance related operation is a recovery operation after malfunction.

10. The image forming apparatus according to claim 1, wherein the function maintenance related operation is a reverse rotating operation of rotating the plurality of image bearers in a direction opposite a direction of rotation during the image forming operation of the plurality of image bearers.

11. The image forming apparatus according to claim 1, wherein the function maintenance related operation is an inching operation of slightly rotating the plurality of image bearers during standby.

12. The image forming apparatus according to claim 1, further comprising an image density detector configured to detect respective image densities of toner images formed on the plurality of image bearers, wherein the toner images include image patterns formed while the plurality of rotation reference position detectors detects the respective rotation reference positions of the plurality of image bearers, wherein the circuitry is configured to acquire periodic fluctuations in image density based on a result of detection performed by the image density detector on the image patterns and time when the plurality of rotation reference position detectors detects the respective rotation reference positions of the plurality of image bearers, and wherein the circuitry is configured to set the relationship between the respective rotation reference positions of the plurality of image bearers based on the acquired periodic fluctuations in image density of the plurality of image bearers.

13. The image forming apparatus according to claim 12, wherein the circuitry is configured to perform the image forming operation without performing the alignment control in a case where the circuitry does not acquire the periodic fluctuations in image density of the plurality of image bearers.

14. The image forming apparatus according to claim 1, further comprising:

an intermediate transfer belt to which images are transferred from the plurality of image bearers; and a belt skewing control assembly configured to control skewing of the intermediate transfer belt, wherein the belt skewing control assembly is configured to perform a belt skewing correction operation as the function maintenance related operation.

15. The image forming apparatus according to claim 1, further comprising:

an intermediate transfer belt to which images are transferred from the plurality of image bearers; and a rotational speed detector configured to detect a rotational speed of the intermediate transfer belt, wherein the function maintenance related operation is an adjusting operation of the rotational speed detector.

16. The image forming apparatus according to claim 1, wherein:

the circuitry is configured to determine whether to perform the alignment control based on the image forming mode.

17. The image forming apparatus according to claim 1, wherein:

wherein the circuitry is configured to determine whether to perform the alignment control based on the image data.

* * * * *